US005708938A

United States Patent [19]

Takeuchi et al.

[11] Patent Number: 5,708,938

[45] Date of Patent: Jan. 13, 1998

[54] WET PROCESS IMAGE FORMING APPARATUS AND CARRIER VAPOR COLLECTING DEVICE THEREFOR

[75] Inventors: Noriyasu Takeuchi, Kawasaki; Tsuneo Kurotori; Masakazu Muranaka, both of Tokyo; Katsuaki Miyawaki, Yokohama; Toshio Inada, Sagamihara; Yusuke Takeda, Yokohama; Sadayuki Iwai, Yokohama; Kozoh Sudoh, Yokohama, all of Japan

[73] Assignee: Ricoh Company, Ltd., Tokyo, Japan

[21] Appl. No.: 572,708

[22] Filed: Dec. 14, 1995

[30] Foreign Application Priority Data

| | | | |
|---|---|---|---|
| Dec. 14, 1994 | [JP] | Japan | 6-333453 |
| Dec. 14, 1994 | [JP] | Japan | 6-333454 |
| Dec. 14, 1994 | [JP] | Japan | 6-333455 |
| Jan. 20, 1995 | [JP] | Japan | 7-26086 |
| Oct. 16, 1995 | [JP] | Japan | 7-293716 |
| Oct. 16, 1995 | [JP] | Japan | 7-293717 |
| Nov. 16, 1995 | [JP] | Japan | 7-323687 |

[51] Int. Cl.[6] ..... G03G 13/10

[52] U.S. Cl. ..... 399/250

[58] Field of Search ..... 355/256, 257, 355/258, 260, 282, 292, 293; 118/645, 652; 396/574, 576, 571, 626, 630, 624; 210/85–87; 399/241, 250

[56] References Cited

U.S. PATENT DOCUMENTS

| | | | |
|---|---|---|---|
| Re. 34,437 | 11/1993 | Ariyama et al. . | |
| 3,854,224 | 12/1974 | Yamaji et al. | 34/77 |
| 3,880,515 | 4/1975 | Tanaka et al. | 399/250 |
| 3,997,977 | 12/1976 | Katayama et al. | 34/73 |
| 4,462,675 | 7/1984 | Moraw et al. | 399/250 |
| 4,640,605 | 2/1987 | Ariyama et al. . | |
| 4,687,319 | 8/1987 | Mishra | 118/61 |
| 4,720,731 | 1/1988 | Suzuki et al. . | |
| 4,733,272 | 3/1988 | Howa et al. | 399/520 |
| 4,800,839 | 1/1989 | Ariyama et al. . | |
| 4,801,965 | 1/1989 | Mochizuki et al. . | |
| 4,833,500 | 5/1989 | Mochizuki et al. . | |
| 5,021,834 | 6/1991 | Tsuruoki et al. . | |
| 5,155,534 | 10/1992 | Kurotori et al. . | |

*Primary Examiner*—D. Rutledge

*Attorney, Agent, or Firm*—Oblon, Spivak, McClelland, Maier & Neustadt

[57] ABSTRACT

A wet process image forming apparatus using a developing liquid consisting of a carrier liquid and a toner dispersed therein, in which air containing carrier vapor produced in, e.g., a fixing section, is sucked by a suction fan via a first duct into a liquefying section. The liquefying section liquefies the carrier vapor and water vapor. A separating section is disposed below the liquefying portion and includes a receptacle. A liquid produced by the liquefying section is caused to flow down into the receptacle along a chain due to its own weight. The separating section separates the liquid into the carrier liquid and water on the basis of a difference in specific gravity. Only the carrier overlying the water in the receptacle is fed to a carrier tank via overflow ports formed in the wall of the receptacle. The water is delivered to a water tank via a pipe. The pipe is so configured as to maintain the liquid level in the receptacle substantially at the level of the overflow ports.

6 Claims, 26 Drawing Sheets

Fig. 13A
PRIOR ART
Fig. 13B
PRIOR ART
Fig. 13C
PRIOR ART
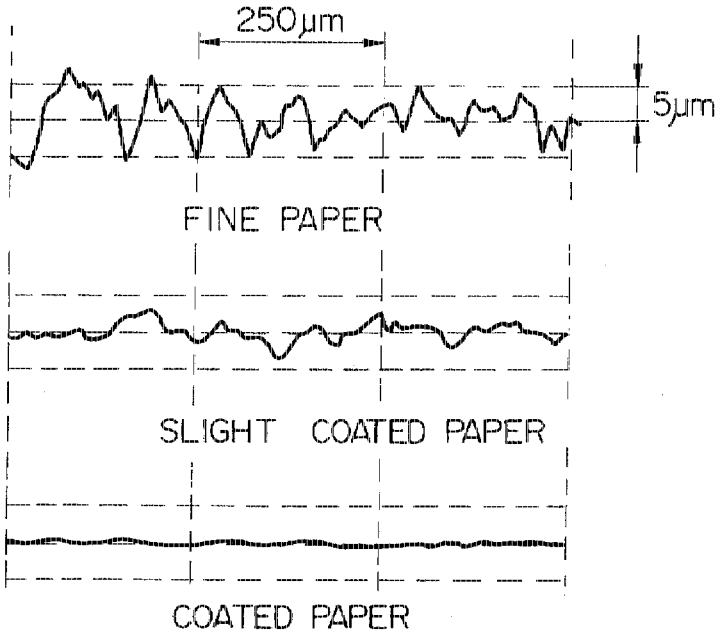
Fig. 14A
PRIOR ART
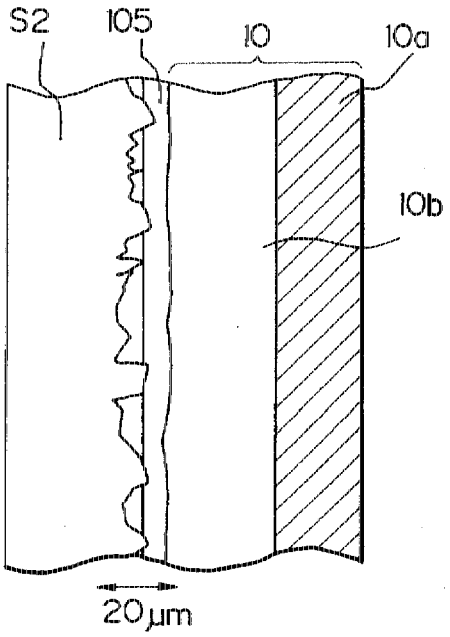
Fig. 14B
PRIOR ART
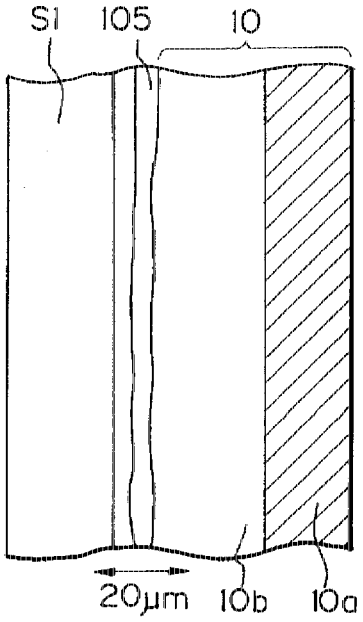

WET PROCESS IMAGE FORMING APPARATUS AND CARRIER VAPOR COLLECTING DEVICE THEREFOR

BACKGROUND OF THE INVENTION

The present invention relates to a copier, facsimile apparatus, printer or similar image forming apparatus of the type using a developing liquid consisting of a carrier liquid and a toner dispersed therein. More particularly, the present invention is concerned with a device for collecting and recycling carrier vapor evaporated from, e.g., a recording medium when a toner image carried on the medium is fixed by heat.

In an electrophotographic image forming apparatus, a developing device has customarily been operated with a single-ingredient type developing powder, i.e., toner, with a two-ingredient type developing powder consisting of a toner and a carrier, or with a developing liquid consisting of a carrier liquid and a toner dispersed therein. The developing device using the developing liquid, i.e., the wet process developing device develops a latent image electrostatically formed on a photoconductive element or similar image carrier with the liquid. The resulting toner image is transferred to a paper or similar recording medium. The medium carrying the toner image thereon is conveyed to a fixing device implemented by a pair of heat rollers. As a result, the toner image on the medium is fixed by heat.

In an image forming apparatus using the wet process developing device, the carrier liquid penetrated into the paper is evaporated when the toner image is fixed by the heat roller pair of the fixing device. As a result, the apparatus is filled with carrier vapor. The carrier vapor should preferably be collected, liquefied, and then discarded or used again.

A device for collecting the carrier vapor has been proposed in various forms in the past. For example, Japanese Patent Laid-Open Publication No. 48-82835 teaches a device including a box having its large surface portion mounted on the outside panel of a copier, and serving as a cooling chamber. Carrier vapor produced in the copier is sucked into the cooling chamber and transformed to mist thereby. The mist is introduced into a liquefying chamber.

Japanese patent Laid-Open Publication No. 48-83838 proposes to deliver a carrier liquid liquefied in a liquefying chamber to a developing liquid tank, carrier liquid replenishing tank, cleaning liquid feeding device, etc.

Japanese Patent Laid-Open Publication No. 51-66836 discloses a device having condensing means including heat exchanging means. The heat exchanging means has two perpendicular paths. Hot air containing carrier vapor and coming out of a drying and fixing chamber is caused to flow through one of the perpendicular paths. Cool air from which the carrier vapor has been removed is caused to flow through the other path. As a result heat exchange occurs between the two perpendicular paths. Liquefying means adsorbs and liquefies a carrier liquid transformed to mist by the condensing means by causing it to flow through a carrier liquid catching member. Blower means sequentially circulates the air through the fixing chamber, condensing means, liquefying means, condensing means, and fixing means in this order.

Japanese Patent Laid-Open Publication No. 49-22145 proposes an electrophotographic copier having a hermetic chamber for receiving a copy (photoconductive paper or transfer paper) fixed and dried. Carrier vapor contained in air flowing into the chamber along the incoming copy, and carrier vapor constantly evaporated are processed in the copier.

Further, U.S. Pat. No. 4,733,272 proposes to collect carrier vapor, collect a carrier liquid and water by passing the vapor through cooling means, removes the water from the collected liquid, and then return only the carrier liquid to a developing section.

We actually applied the above conventional devices for carrier vapor collection to a wet process developing device, and used carrier liquids collected by the devices to develop latent images. We found that the conventional devices cause images to be partly lost. A series of extended researches and experiments showed that the above occurrence is ascribable to water contained in the collected carrier liquid. The water is fed to the image carrier together with the carrier liquid, and causes the charge of the latent image to leak. Presumably, such water is evaporated from the paper in the event of fixation and then collected together with the carrier vapor.

In the apparatus disclosed in the above U.S. Pat. No. '272, the water existing together with the carrier vapor is separated from the liquid produced by liquefaction, so that only the carrier liquid is collected. With this scheme, it is possible to reduce the occurrence that the water causes the charge of the latent image to leak and thereby causes an image to be partly omitted. However, it was found that even if, e.g., 100 ppm of water is mixed with the carrier liquid to be recycled for development, the electric resistance of the carrier liquid is reduced by one figure. Although the water content as small as 100 ppm may reduce the local omission of images, the local omission still occurs when the water content has specific values greater than 100 ppm. Therefore, it is important that the water be separated from the carrier liquid as surely as possible, as determined by experiments.

Furthermore, the water separated from the liquid is partly derived from the atmosphere. How much of this kind of water is collected depends on the atmospheric temperature and the cooling temperature for liquefaction. Because the water cannot be reused in the image forming apparatus, it must be drained by an exclusive arrangement, or stored in an exclusive tank and periodically discarded, or evaporated by heat. Hence, from the easy handling standpoint, it is necessary that the amount of water to be collected be minimized. Although the apparatus should preferably be operated in a low humidity environment, such an environment is not available without limiting the location for the installation of the apparatus.

On the other hand, an electrostatic image transfer system has been customary with the wet process image forming apparatus. The system forms an electric field between a photoconductive element and a paper, and transfers toner particles forming an image from the element to the paper by electrophoresis to occur in a carrier liquid. For example, corona charge opposite in polarity to the toner may be applied from the rear of the paper contacting the toner image. Alternatively, a bias opposite in polarity to the toner may be applied to a transfer roller contacting the paper. Further, a bias opposite in polarity to the toner may applied from the rear of a transfer belt electrostatically retaining the paper thereon. These specific methods are taught in, e.g., Japanese Patent Laid-Open Publication No. 5-224491.

However, the problem with the above image transfer system is that it cannot transfer images in a desirable manner without regard to the kind of a paper. Particularly, the scheme which applies a bias from the rear of the belt via an electrode member and transfers the toner by electrophoresis in the resulting electric field has the following problem. Discharge occurs between the belt and the electrode member at a position upstream of the position where they contact each other with respect to the direction in which the belt conveys the paper. The discharge disturbs the toner image transferred from the photoconductive element to the paper, thereby lowering the image quality. This is particularly conspicuous when the voltage applied to the electrode member is high, as also determined by experiments.

SUMMARY OF THE INVENTION

It is therefore an object of the present invention to provide a wet process image forming apparatus and capable of surely separating water from a collected carrier liquid, and allowing the carrier liquid to be recycled, and a carrier vapor collecting device therefor.

It is another object of the present invention to provide a wet process image forming apparatus capable of reducing the amount of water to be collected by a carrier vapor collecting device together with carrier vapor, and a carrier vapor collecting device therefor.

It is another object of the present invention to provide a wet process image forming apparatus capable of automatically recycling a carrier liquid collected in the apparatus, and a carrier vapor collecting method therefor.

It is another object of the present invention to provide a wet process image forming apparatus capable of forming attractive images without regard to the kind of recording media.

It is another object of the present invention to provide a wet process image forming apparatus capable of transferring a toner image from a photoconductive element or similar image carrier to a paper or similar recording medium without disturbing the image.

In accordance with the present invention, a carrier vapor collecting device for a wet process image forming apparatus has a liquefying section for liquefying carrier vapor collected, and a separating section for separating a liquid produced by the liquefying section into a carrier liquid and water on the basis of a difference in specific gravity. The separating section has a chamber for receiving the liquid produced by the liquefying section, a carrier liquid overflow port formed in the side wall of the chamber, and a level maintaining portion for maintaining the interface between the carrier liquid and the water separated in the chamber at a predetermined level lower than the carrier liquid overflow port.

Also, in accordance with the present invention, a carrier vapor collecting device for a wet process image forming has a liquefying section for liquefying carrier vapor collected, a separating section for separating a liquid produced by the liquefying section into a carrier liquid and water, a water tank for storing the water separated by the separating section, a liquid level sensor for sensing a liquid level in the water tank, and a signal generating section for generating a signal in response to the output of the liquid level sensor.

Also, in accordance with the present invention, a carrier vapor collecting device for a wet process image forming apparatus has a liquefying section for liquefying carrier vapor collected, a separating section for separating a liquid produced by the liquefying section into a carrier liquid and water, a water tank for storing the water separated by the separating section, and a sheet floated on the water stored in the water tank, and adsorptive to the carrier liquid.

Also, in accordance with the present invention, a carrier vapor collecting device for a wet process image forming apparatus has a liquefying section for liquefying carrier vapor collected, a separating section for separating a liquid produced by the liquefying section into a carrier liquid and water, a carrier liquid tank for storing the carrier liquid separated by the separating section, a liquid level sensor for sensing a liquid level in the carrier liquid tank, and a signal generating section for generating a signal in response to the output of the liquid level sensor.

Also, in accordance with the present invention, a carrier vapor collecting device for a wet process image forming apparatus has a liquefying section for liquefying carrier vapor collected, a separating section for separating a liquid produced by the liquefying section into a carrier liquid and water, and at least one of a carrier tank for storing the carrier liquid separated by the separating section, and a water tank for storing the water separated by the separating section. A portion of a member constituting the separating section which contacts the liquid and the inner periphery of the tank are formed of a rustproof material.

Also, in accordance with the present invention, a carrier vapor collecting device for a wet process image forming apparatus has a liquefying section for liquefying carrier vapor collected, and a separating section for separating a liquid produced by the liquefying section into a carrier liquid and water. The separating section has a chamber positioned below an outlet of the liquefying section, and for receiving the liquid produced by the liquefying section via an opening formed in the top of the chamber. A member extends from the outlet into the chamber, and causes the liquid to flow down from the outlet into the chamber via the opening along the member.

Further, in accordance with the present invention, a carrier vapor collecting device for a wet process image forming apparatus has a liquefying section for liquefying carrier vapor collected, and a separating section for separating a liquid produced by the liquefying section into a carrier liquid and water. The liquefying section has a cooling device for cooling fins disposed in a path in which the carrier liquid flows. At least a part of surfaces of the fins is formed with a material which the carrier liquid sparingly wets.

Furthermore, in accordance with the present invention, a carrier vapor collecting device for a wet process image forming apparatus has a vapor collection chamber formed by a cover member substantially hermetically closing a fixing section where carrier vapor is easily produced. A liquefying section is formed with an inlet for receiving an air stream flowing out of the chamber, and liquefies the carrier vapor coming in via the inlet. A separating section separates a liquid produced by the liquefying section into a carrier liquid and water. An stream generating device is disposed in a path in which the liquefying section is disposed, but downstream of the liquefying section, and generates the air stream.

Moreover, in accordance with the present invention, in a wet process image forming apparatus having a developing device storing a developing liquid consisting of a carrier liquid and a toner, and a carrier vapor collecting device, the carrier vapor collecting device has a liquefying section for liquefying carrier vapor collected, and a separating section for separating a liquid produced by the liquefying section into the carrier liquid and water. Air from which the carrier vapor is removed by the liquefying section is returned into the body of the image forming apparatus.

In addition, in accordance with the present invention, in a wet process image forming apparatus comprising a developing device storing a developing liquid consisting of a carrier liquid and a toner, and a carrier vapor collecting device, the carrier vapor collecting device has a liquefying section for liquefying carrier vapor collected, a separating section for separating a liquid produced by the liquefying section into the carrier liquid and water, a conduit member for feeding the carrier liquid separated by the separating section to the developing device, and a pressure generating device for generating a pressure for forcing the carrier liquid into the conduit member.

BRIEF DESCRIPTION OF THE DRAWINGS

The above and other objects, features and advantages of the present invention will become more apparent from the following detailed description taken with the accompanying drawings in which:

FIGS. 13A, 13B and 13C respectively show the surface configuration of the fine paper, that of the coated paper, and that of a slightly coated paper which is another conventional paper;

FIGS. 14A and 14B respectively demonstrate the transfer of a toner image to the fine paper and the coated paper;

DESCRIPTION OF THE PREFERRED EMBODIMENTS

Preferred embodiments of the wet process image forming apparatus and a carrier vapor collecting device in accordance with the present invention will be described. In all the embodiments, the image forming apparatus is implemented as an electrophotographic color copier by way of example.

1st Embodiment

Figure 1A:
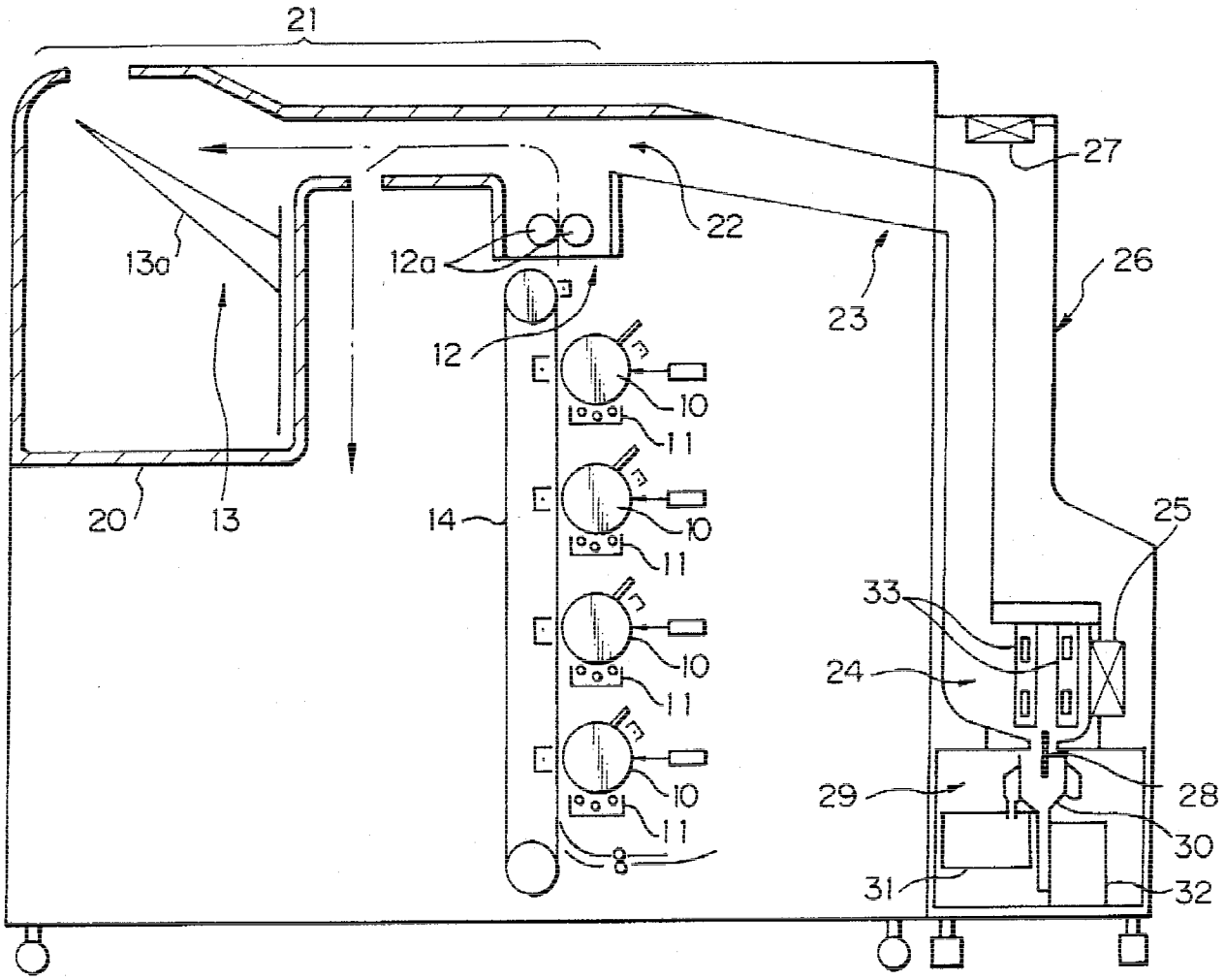
FIG. 1A is a section showing a first embodiment of an image forming apparatus and a carrier vapor collecting device in accordance with the present invention.
Figure 1B:
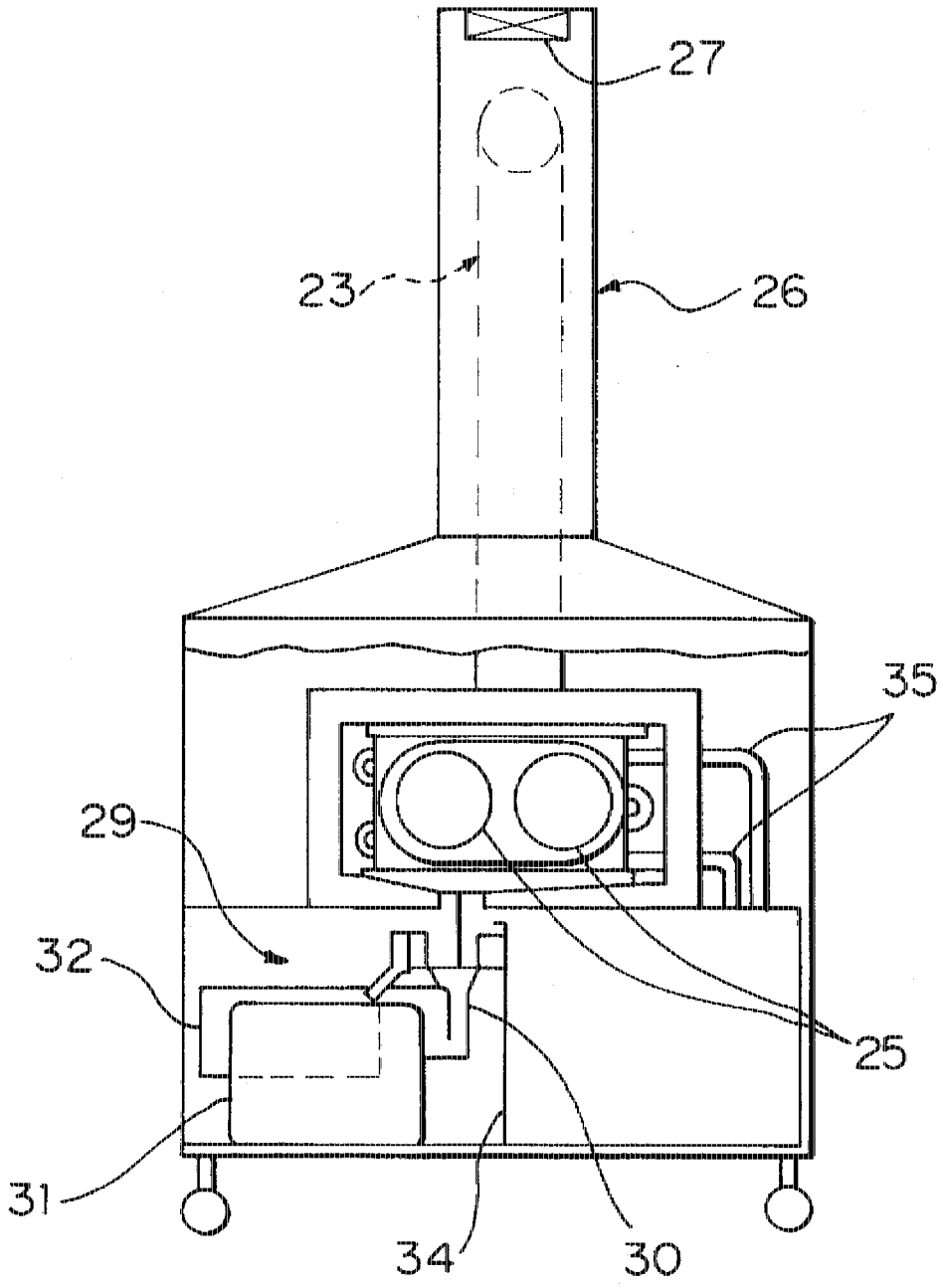
FIG. 1B is a side elevation of the carrier vapor collecting device shown in FIG. 1A.

Referring to FIG. 1A of the drawings, a color copier has a plurality of photoconductive elements or drums 10 each being assigned to a particular color. A latent image is electrostatically formed on each drum 10 and then developed by a respective developing device 11 to turn out a color image. The color image is transferred to a paper or similar recording medium. A fixing device 12 has a heat roller pair 12*a* and fixes the color image on the paper. Then, the paper with the fixed image is driven out to a stacking device implemented as a tray 13*a*. The developing devices 11 each uses a developing liquid consisting of a carrier liquid or solvent, and a toner dispersed therein. For the solvent, use is made of an isoparaffin-based or similar organic solvent having a high volume resistivity, e.g., Isoper (trade name) available from Exon. In the copier, a belt 14 is used to convey the paper and arranged to face the drums 10. FIG. 1B shows a carrier vapor collecting device embodying the present invention and included in the above copier.

Figure 2:
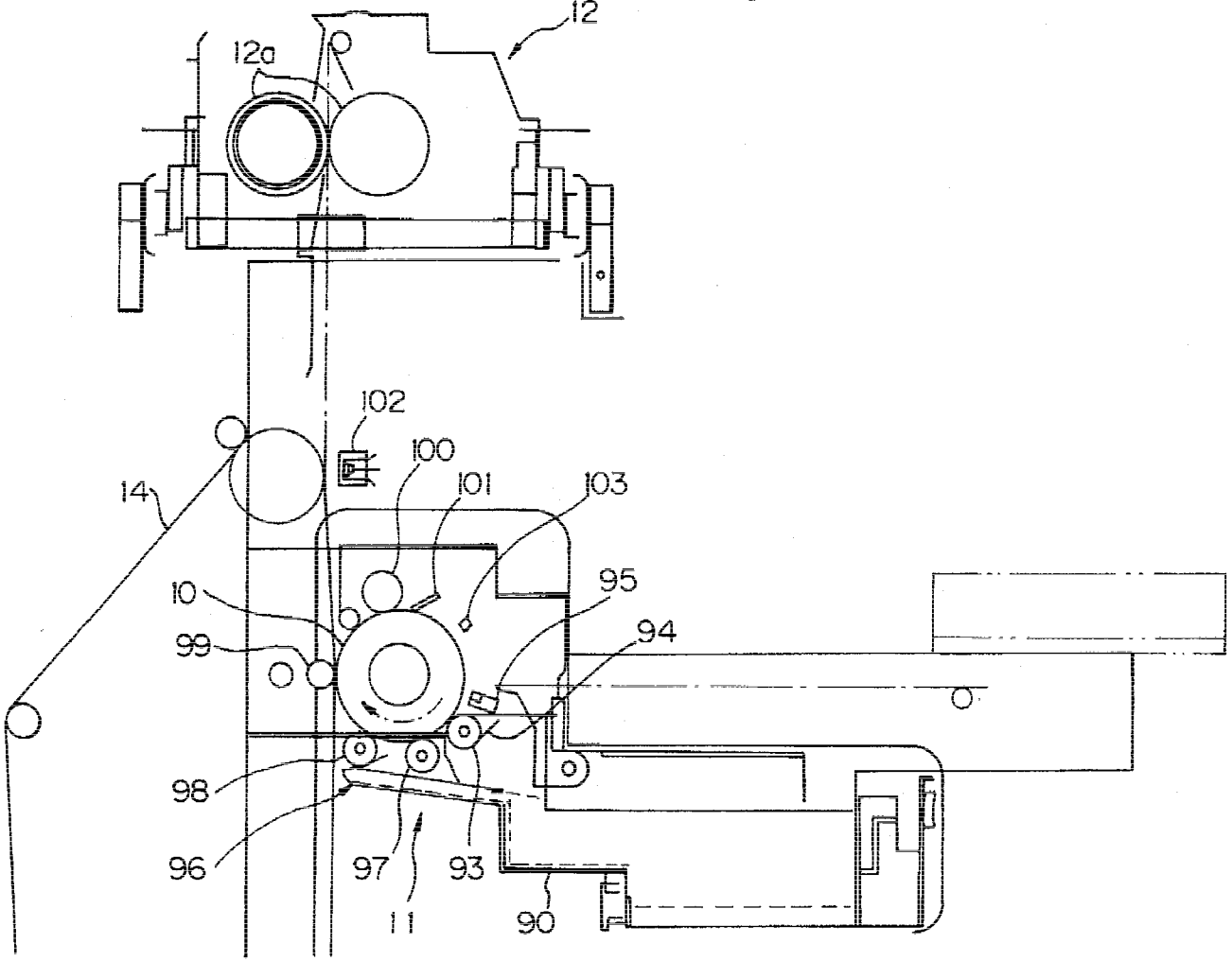
FIG. 2 shows the combination of a top photoconductive element and a top developing device include in the embodiment.

FIG. 2 shows the combination of the uppermost drum 10 and uppermost developing device 11, as viewed in FIG. 1A, in detail. The other drums 10 and developing devices 11 are constructed and arranged in the same manner as the top drum 10 and top developing device 11. As shown, the developing device 11 has a developing roller 93 spaced from the drum 10 by a small gap. The roller 93 is rotated in the opposite direction to the drum 10 and at a higher peripheral speed than the drum 10. A scraper 94 is held in contact with the roller 93. A nozzle 95 feeds the developing liquid from a reservoir 90 to between the roller 93 and the scraper 94. The roller 93 and scraper 94 cooperate to convey the liquid to the surface of the drum 10. The previously mentioned latent image is formed on the drum 10 by a charger 103 and an optical writing device, not shown. The liquid conveyed to the drum 10 develops the latent image. The excess part of the liquid passed through between the drum 10 and the roller 93, and the liquid joined in the development are collected in a receiving portion 96 forming part of the reservoir 90. A squeeze roller 97 is spaced from the drum 10 by a shall distance and rotated in the same direction as the drum 10. The liquid left on the drum 10 is squeezed off the drum 10 by the roller 97. An electric field roller 98 is also spaced from the drum 10 by a small distance such that it does not contact the developed image or toner image carried on the drum 10. A voltage of the same polarity as the toner image is applied to the roller 98. The toner deposited on the drum 10 and constituting the toner image is brought to the roller 98 by the drum 10 by way of the position where the roller 97 faces the drum 10. As a result, the cohesion of the toner is intensified by the roller 98. A transfer bias roller 99 forms an electric field for image transfer. The toner image is transferred from the drum 10 to the paper by such an electric field on the basis of electrophoresis. After the image transfer, the surface of the drum 10 is cleaned by a cleaning roller 100 and a cleaning blade 101 contacting the drum 10. Finally, the charge remaining on the drum 10 is dissipated by a discharging device 102.

As shown in FIG. 1A, the fixing device 12 and stacking device 13 are enclosed by a cover member 20 in a substantially hermetic condition. The cover 20 forms a chamber 21 for confining the vapor of the carrier liquid which is produced at the time of fixation.

The carrier vapor collecting device shown in FIG. 1B, as well as at the right-hand side in FIG. 1A, has a first duct portion or air stream generating device 23, a liquefying section 24 at which the duct portion 23 terminates, and suction fans 25. The duct portion 23 is fluidly communicated to an outlet 22 formed in the wall of the chamber 21, and is so inclined as to be lower at the downstream side than at the upstream side with respect to an air steam. The suction fans 25 suck air existing in the chamber 21 and containing the carrier vapor via the duct portion 23 and liquefying section 24. The liquefying section 24 liquefies the carrier vapor contained in air passing therethrough, water vapor produced from the paper, and moisture originally contained in the atmosphere, as will be described specifically later. The air coming out of the liquefying section 24 is blown out to a second duct portion 26 extending along the outer periphery of the duct portion 23. An auxiliary fan 27, although not essential, discharges the air from the second duct portion 26 to the outside of the copier.

An outlet 28 is formed through the bottom wall of the liquefying section 24. A carrier/water separating section 29 is located below the outlet 28 and includes a receptacle 30. The carrier liquid and water liquefied by the liquefying section 24 is introduced into the receptacle 30 via the outlet 28 due to their own weight. The separating section 29 separates the carrier liquid and water from each other, as will be described specifically later. Then, the carrier liquid and water are respectively stored in tanks 31 and 32 assigned thereto. The carrier liquid stored in the tank 31 is again used by the developing units 11 and cleaning unit, not shown.

Figure 3:
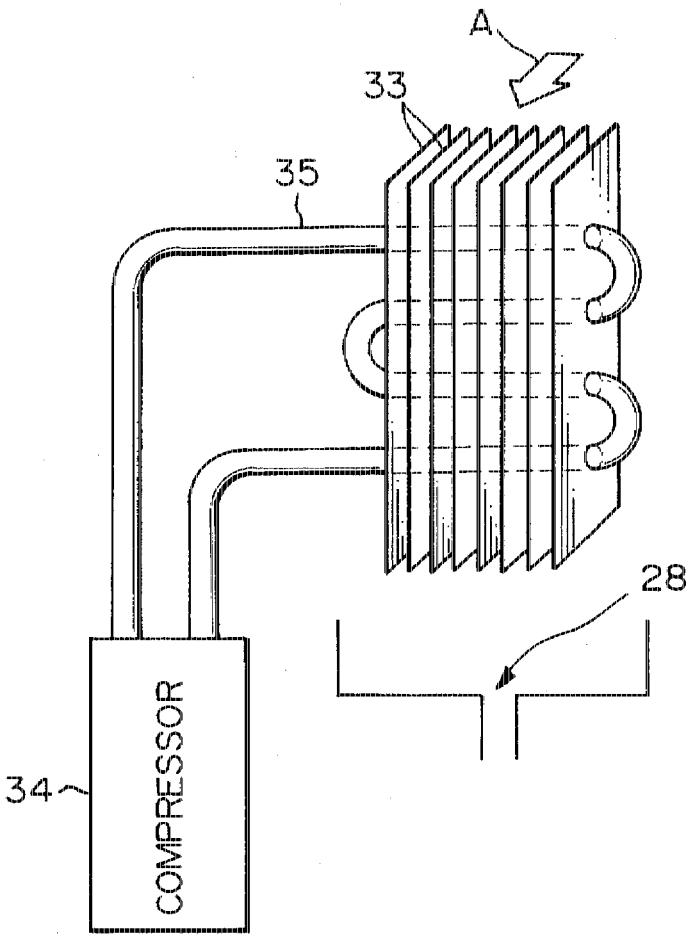
FIG. 3 shows a liquefying section included in the carrier vapor collecting device.

The liquefying section 24 liquefies the vapor by cooling it off. For this purpose, the section 24 has a fin assembly made up of a plurality of fins 33 and located above the outlet 28. The fin assembly is communicated to a compressor 34 by refrigerant pipes 35. As shown in FIG. 3, the fin assembly should preferably be positioned such that the fins 33 extend parallel to an air stream A generated by the fans 25.

The air from the duct portion 23 and containing the carrier vapor has been cooled to some degree by the duct portion 23. The liquefying section 24 cools such air with a refrigerant to a temperature at which the carrier liquid and water can be sufficiently liquefied. As a result, the carrier liquid and water are deposited on the fins 33 and the inner periphery of the section 24, and then caused to flow into the outlet 28 due to their own weight.

Figure 4A:
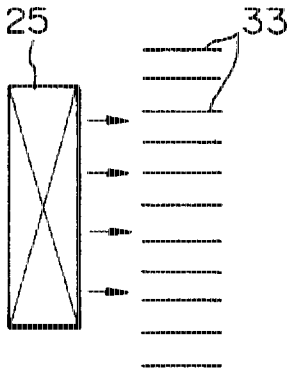
FIGS. 4A and 4B each shows a particular arrangement of cooling fins and a suction fan included in the liquefying section.
Figure 4B:
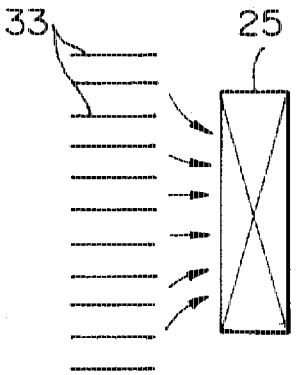

The fans 25 are located downstream of the fins 33 with respect to the air stream, as stated above. The resulting cooling effect is more noticeable than when the fans 25 are positioned upstream of the fins 33. Specifically, as shown in FIG. 4A, when each fan 25 is positioned upstream of the fins 33, the air stream available is limited to the sectional area of the fan 25. Hence, the air stream is short in the peripheral portion of the fins 33. By contrast, as shown in FIG. 4B, the embodiment locates the fan 25 at the downstream side of the fins 33 and thereby allows the air stream along the inner periphery of the duct portion 23 to effectively contact even the peripheral portion of the fins 33.

Further, the fans 25 are located downstream of the liquefying section 24 with respect to the air stream. In this condition, only the residual carrier liquid and water from the liquefying section 24 contact the blades of the fan. This reduces the dew condensation on the blades of the fans 25, compared to the case wherein the fans 25 are located upstream of the section 24. As a result, the embodiment is capable of conveying the carrier liquid efficiently with the air flowing from the outlet 21 of the chamber 21 to the section 24.

The air from the chamber 21 is cooled by the duct portion 23, as stated previously. Hence, liquid drops, particularly the drops of water which is easy to liquefy, deposit on the inner periphery of the duct portion 23 also. These liquid drops flow down along the bottom of the inclined duct portion 23 due to their own weight, and gather at the liquefying section 24 rapidly. In addition, because the air to be driven out of the copier is caused to flow through the duct portion 26 along the outer periphery of the duct portion 23, the preliminary cooling and liquefaction by the duct portion 23 is enhanced. Consequently, the cooling device using the refrigerant can be miniaturized.

It is preferable from the rust preventing standpoint that the member constituting the duct portion 23 and the member constituting the chamber 21 have their inner surfaces formed of resin or rustproof metal, e.g., aluminum or stainless steel. Further, the inner surfaces of such members should preferably be treated for water repellency.

Also, the fins 33 should preferably be partly or entirely treated for oil repellency so as to be sparingly wetted by the carrier liquid. For this treatment, use may be made of 4-ethylene fluoride, 3-ethylene fluoride, vinylidene fluoride, 4-ethylene fluoride and 6-propylene fluoride copolymer, IH-pentadecafluorooctylmethacrylate, lauric acid perfluoride, vinyl chloride, alcohol perfluoride, perfuloro-alkylester copolymer, or fluorine-contained hydroxy unsaturated ester copolymer. An oil-repellent layer is capable of repelling the carrier liquid. The oil-repellent substance may be applied to the fins 33 by any suitable method matching the substance. As to IH-pentadecafluorooctylmethacrylate, for example, it should simply be diluted by a volatile solvent and then sprayed; a coating is formed due to the evaporation of the solvent.

Assume that the surfaces of the fins 33 are at least partly formed of the above substance which is sparingly wetted by the carrier liquid. Then, even in a structure wherein the surface of each fin 33 adjoins the surface of another member, e.g., nearby fin 33, an occurrence that the liquid drops deposited on the fins reduce the gap between the nearby fins, thereby obstructing the flow of air, can be avoided. Hence, the liquefaction based on cooling is insured over a long period of time.

Figure 5:
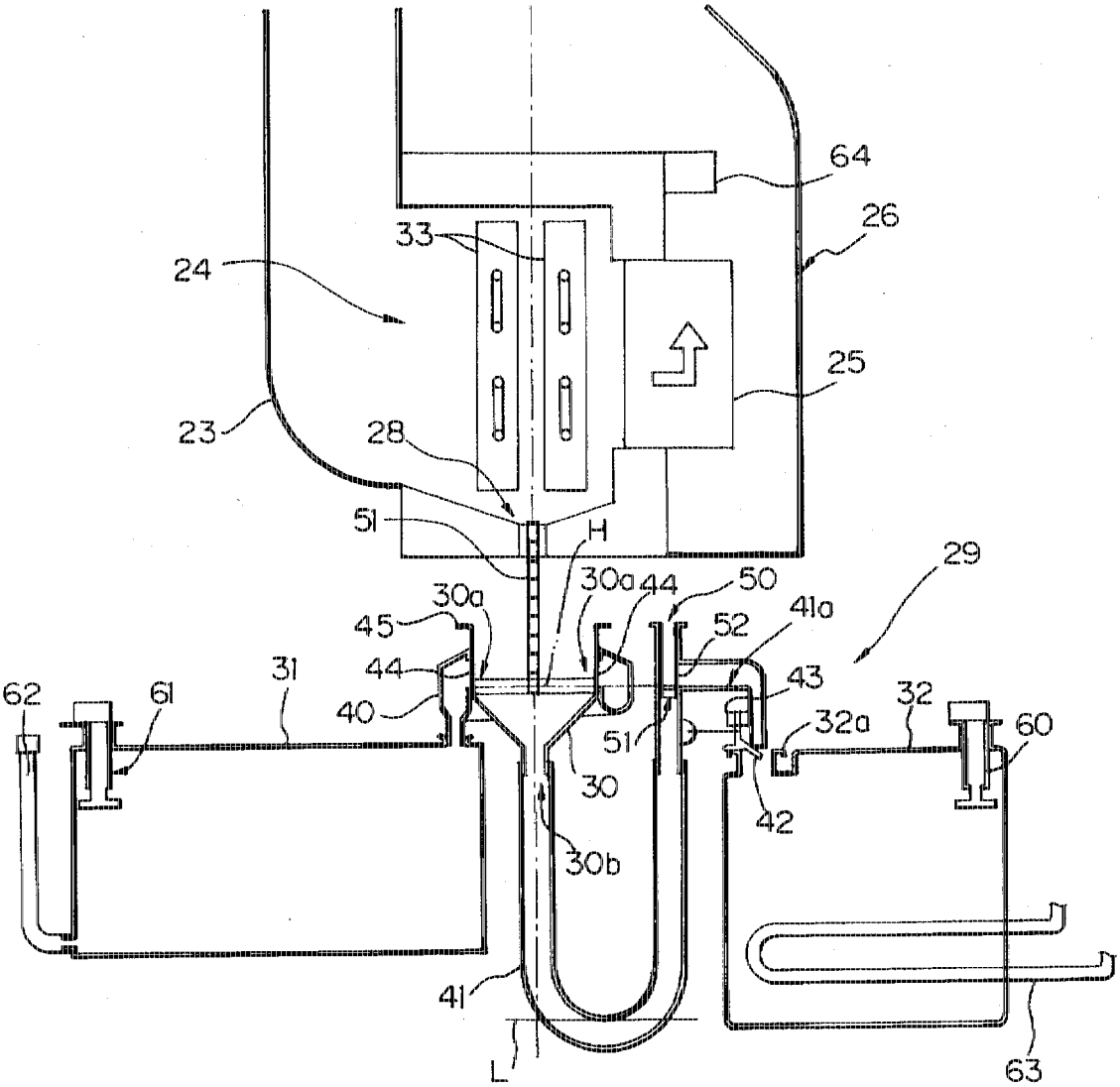
FIG. 5 shows a separating section also included in the carrier vapor collecting device.

The separating section 29 separates the carrier liquid and water on the basis of a difference in specific gravity between them (e.g., an isoparaffin-based organic solvent has a specific gravity ranging from 0.7 to 0.8 relative to water). As shown in FIG. 5, the separating section 29 has a guide member 40 and a drain pipe 41 in addition to the previously mentioned receptacle 30. The receptacle 30 is open at its top and formed with overflow ports 30*a* in its side wall. The guide member 40 surrounds the overflow ports 30*a*, and receives the liquid overflowing the receptacle 30 via the ports 30*a*. The liquid overflown the receptacle 30 is guided to the carrier tank 31 by the guide member 40. The receptacle 30 is also formed with a liquid outlet 30*b* lower in level than the overflow ports 30*a*. The drain pipe 41 communicates the liquid outlet 30*b* to the water tank 32.

At a position corresponding to the end of the tank 32, the highest bottom of the inner periphery of the drain pipe 41 is located a position flush with an overflow liquid level H which is determined by the lower ends of the overflow ports 30*a*. The part of the pipe 41 extending between the position 41*a* and the outlet 30*b* of the receptacle 30 is lower than the overflow liquid level H. A valve 42 is mounted on the end of the pipe 41 adjoining the tank 32. The tank 32 is so set as to actuate the valve 42 with a color portion 32*a* thereof which is positioned at the edge of a water inlet. A sensor 43 responsive to the set condition of the tank 32 is also mounted on the pipe 41. The pipe 41 is formed with a mouth 50 at a level higher than the position 41*a* and for the entry of water. A holder 52 has a filter 51 at its end, and protrudes into the pipe 41 via the mouth 50. The filter 51 filters out dust and other impurities. If desired, the filter 51 may be located any other position of the pipe 41, e.g., the end of the pipe 41 adjoining the tank 32.

A mesh 44 having a mesh size of 20 μm to 200 μm is fitted in each overflow port 30*a*. The mesh 44 allows the carrier liquid to pass therethrough, but prevents water from doing so. Why the mesh can be used to separate the carrier liquid and water is presumably that they are different in wettability. Preferably, the mesh 44 is formed of stainless steel, nylon, polyester, polyethylene, polypropylene, Tetoron, glass, or fluorine-contained resin.

Figure 6A:
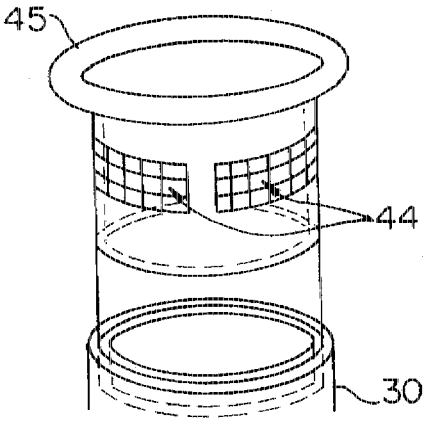
FIGS. 6A–6C each shows a particular configuration of the separating section.
Figure 6B:
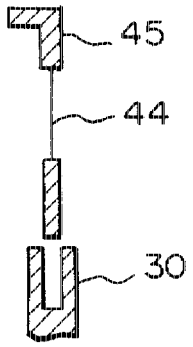

As shown in FIGS. 6A and 6B, it is preferable that a collar 45 forming a part of the receptacle 30 and formed with the overflow ports 30*a* be separable at the intermediate between its upper portion including the ports 30*a* and its lower portion. Then, the upper portion of the collar 45 can be used as a holder for holding the meshes 44 and easy to replace.

As shown in FIG. 5, in the embodiment, a chain 51 is anchored at its upper end to the structural body of the liquefying section 24. The chain 51 hangs down from the liquefying section 24 to a level lower than the overflow liquid level H. This allows the liquid to smoothly flow from the outlet 28 of the section 24 to the liquid level in the receptacle 30 along the chain 51.

When the copier is set up, water is poured into the intermediate portion of the drain pipe 41, which is lower in level than the overflow liquid level H, via the mouth 50 until it enters the receptacle 30 and reaches a level slightly lower than the level H. In this condition, the carrier liquid and water mixture is caused to flow down from the outlet 28 of the liquefying section 24 into the receptacle 30. In the receptacle 30, the carrier liquid is separated from water due to a difference in specific gravity; a carrier layer overlies a water layer. The part of the carrier layer above the overflow liquid level H overflows the receptacle 30 via the overflow ports 30*a*, and flows to the carrier tank 31 by way of the guide member 40. While the flow-down of the liquid from the liquefying section 24, the carrier and water separation based on the difference in specific gravity, and the overflow of the carrier liquid are under way, the liquid level in the part of the drain pipe 41 adjoining the receptacle 30 and the liquid level in another part of the pipe 41 adjoining the highest position 41*a* tend to be balanced with each other.

More specifically, when the amount of the liquid in the receptacle 30 increases, the liquid level in the end portion of the pipe 41 tends to rise. However, because the highest position 41*a* of the pipe 41 is the overflow level into the tank 32, the part of the liquid tending to rise above the position 41*a* overflows into the tank 32. In addition, the position 41*a* is flush with the overflow liquid level H of the receptacle 30. As a result, the liquid in the receptacle 30 is substantially maintained at the liquid level H. In this manner, only the carrier layer overlying the water layer in the receptacle 30 faces the overflow ports 30*a*.

Even when the liquid level in the receptacle 30, i.e., the interface between the carrier layer and the water layer rises above the overflow level H, the meshes 44 surely prevent water from overflowing via the ports 30*a* which lead to the tank 31. If desired, by positively using such selective permeability of the meshes 44, the highest position 41*a* of the pipe 41 may be located such that the interface between the carrier layer and the water layer in the receptacle 30 is higher than the overflow level H.

Because the liquid in the liquefying section 24 flows down only slowly along the chain 51 via the outlet 28, it forms a minimum of bubbles in the liquid existing in the receptacle 30, compared to the case wherein the chain 51 is absent. The bubbles would prevent the carrier liquid and water from being rapidly separated from each other in the receptacle 30. In addition, because the lower or free end of the chain 51 is deformable, it will not obstruct the receptacle 30 even if the receptacle 30 is provided with a removable configuration.

If the copier is left unused over a long time, then water in the drain pipe 41 simply vaporizes. Assume that the liquid level, i.e., the interface between the carrier layer and the water layer is lowered to a level L at which spaces in the two portions of the pipe 41 respectively adjoining the receptacle 30 and tank 32 are communicated to each other. Then, the carrier liquid flown down from the liquefying section 24 into the receptacle 30 due to the subsequent carrier collection enters the portion of the pipe 41 adjoining the tank 32 via the lowermost portion of the same. As a result, when water is introduced from the portion 24 into the receptacle 30 later, the liquid level in the pipe 41 increases and causes the above carrier liquid to rise in the portion of the pipe 41 adjoining the tank 32. Finally, this carrier liquid undesirably flows into the tank 32.

Figure 6C:
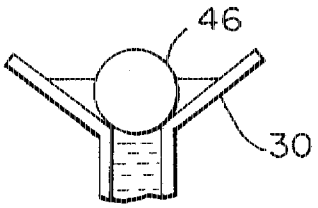

In light of the above, as shown in FIG. 6C, it is preferable that a floatable stop 46 be disposed in the receptacle 30. The stop 46 is so configured as to rest on the edge of the outlet 30*b* of the receptacle 30, as illustrated. The stop 46 has a specific gravity intermediate between the specific gravity of the carrier liquid and that of water. Hence, the stop 46 cannot float away from the bottom of the receptacle 30 when subjected only to buoyancy attributable to the carrier liquid. Usually, the stop 46 is at least partly immersed in the water layer in the receptacle 30. As the liquid level in the receptacle 30 falls, the stop 46 also falls. When the liquid level decreases to a certain degree, the stop 46 rests on the edge of the outlet 30*b* and thereby stops the outlet 30*b*. Therefore, the stop 46 prevents the carrier liquid remaining in the receptacle from flowing into the pipe 41 via the outlet 30*b* although the liquid level in the pipe 41 may fall.

When the stop 46 is used for stopping the outlet 30*b*, it is preferable to set up a condition which allows practically no carrier liquid to flow down past the position where the stop 46 engages with the edge of the outlet 30*b*. This can be done if the following condition is satisfied. Assume that a part of the stop 46 is sunk under the water layer while the other part is fully sunk under the carrier layer; the volume of the stop 46 sunk under the carrier layer is minimum. Then, the shape of the outlet 30*b* and that of the stop 46 and the specific gravity of the stop 46 are selected such that the portion of the stop 46 higher than the interface between the carrier layer and the water layer contacts the edge of the outlet 30*b*.

In FIG. 6C, the stop 46 has a spherical shape in order to rest on the edge of the funnel-like outlet 30*b*. Alternatively, a weight may be accommodated in the stop 46 at a position deviated from the center. Then, the portion of the stop 46 expected to engage with the edge of the outlet 30*b* may be provided with a shape engageable with the outlet 30*b*.

In order to prevent water in the pipe 41 from becoming rotten and stinking, an ultraviolet radiation device may be used to sterilize it, or an antiseptic may be introduced in water beforehand. When ultraviolet rays are applied from the outside of the pipe 41, at least the part of the pipe 41 to receive the rays should be formed of a material permeable to the rays.

A sensor 60 (see FIG. 5) should preferably be mounted on the tank 32 in order to sense the liquid level in the tank 32. When the tank 32 is filled up, a display may be driven, or the operation of the copier or that of the carrier collecting device may be interrupted, in response to the resulting output of the sensor 60.

A sensor, not shown, may be used to sense the liquid level in the receptacle 30. When the liquid in the receptacle 30 reaches a preselected level, the operation of the copier or that of the carrier collecting device may be interrupted in response to the resulting output of the sensor.

A sheet formed of an oleophilic substance should preferably be floated on the liquid in the tank 32 so as to collect the carrier liquid introduced into the tank 32 by accident. This kind of sheet may be implemented as a water-repellent oleophilic sheet, e.g., an unwoven sheet formed of polyethyrene fibers or polypropylene fibers.

A drain 62 (see FIG. 5) may be connected to a lower portion of the tank 31 assigned to the carrier liquid. A similar drain may be connected to a lower portion of the tank 32 assigned to water. Also, a discharge pump may be disposed in the tank 31 and/or 32 in place of or in addition to the above drain.

The top of the tank 32 or one end of a conduit communicated at the end to the top of the tank 32 may be open to the outside of the copier. Then, vapor produced in the tank 32 will be constantly released to the outside of the copier. If desired, the vaporization of water in the tank 32 may be promoted by a heater or an ultrasonic vibrator.

The compressor 34 (FIG. 3) has a heat radiating portion 63 (see FIG. 5). An arrangement may be made such that the portion 63 of the compressor 34 is cooled by water existing in the tank 32.

A sensor 61 (see FIG. 5) may be mounted on the tank 31 in order to sense the liquid level in the tank 31. Then, when the tank 31 is filled up, a display may be driven in response to the output of the sensor 61, or the operation of the copier or that of the carrier collecting device may be interrupted.

The inner surfaces of the tanks 31 and 32, as well as the parts of the separating portion 24 with which the liquid contacts, should preferably be formed of a substance which does not easily rust, e.g., resin or aluminum, stainless steel or similar rustproof metal.

Means for sensing the carrier vapor concentration may advantageously be disposed in the chamber 21. Then, when the concentration exceeds a preselected value, as determined by the sensor, the copying operation under way may be interrupted, or any further copying operation may be inhibited.

A sensor responsive to temperature inside the chamber 21 may also be disposed in the chamber 21. The copying operation under way may be interrupted, or the next copying operation may be inhibited, on the basis of the output of the sensor.

An excessive increase in carrier vapor concentration or temperature inside the chamber 21 and attributable to, e.g., the defective operation of the fans 25 brings about the following troubles. When the carrier vapor concentration is excessive, the vapor leaks to the outside of the chamber 21 via, e.g., clearances between the members forming the chamber 21 and an inlet assigned to copies. This prevents the carrier vapor from being collected. Moreover, the vapor is apt to form liquid drops on the inner periphery of the cover 20 due to dew condensation. Such liquid drops would fall onto the paper being conveyed through the fixing device 12 as well as other devices, resulting in a defective image. When the temperature inside the chamber 21 is elevated to an excessive level due to, e.g., heat generated by the fixing device 12, the temperature of the cover 20 rises. In this condition, it is difficult to deal with a jam.

Figure 7A:
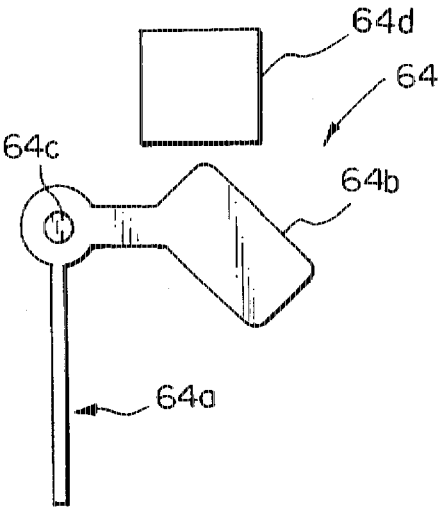
FIGS. 7A and 7B show a specific configuration of an air flow sensor included in the liquefying section.
Figure 7B:
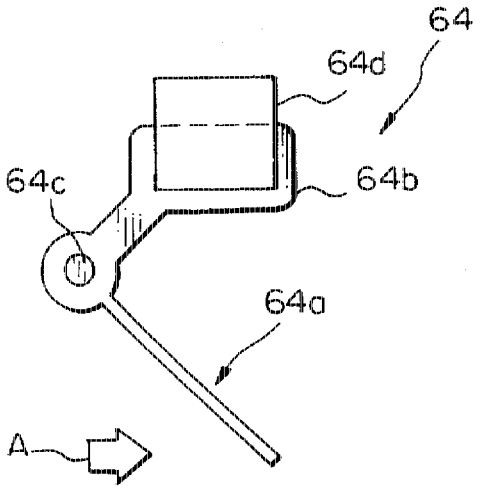

A sensor 64 (see FIG. 5) may be disposed in the conduit extending from the chamber 21 to the liquefying section 24 or the conduit following the section 24 in order to sense the flow rate of air in the conduit. Then, the operation of the copier may be allowed only when the flow rate is higher than a preselected value. FIGS. 7A and 7B show a specific configuration of the sensor 64. As shown, the sensor 64 has a sensor body 64*d*, and a probe made up of a blade 64*a* and a piece 64*b* to be sensed by the sensor body 64*d*. The probe is rotatably mounted on a shaft 64*c*. The sensor 64*d* senses the movement of the blade 64*a* via the piece 64*b*. This also successfully eliminates the above problems and, in addition, prevents the cooling device of the liquefying section 24 and using the refrigerant from being continuously operated in the absence of the air stream; otherwise, the refrigerant would be solidified.

As described above, the illustrative embodiment separates the liquid collected into the carrier liquid and water. Hence, only the carrier not containing water can be collected and used again.

2nd Embodiment

A second embodiment of the present invention will be described hereinafter. In this embodiment, the same or similar constituents as or to the constituents of the first embodiment are designated by the same reference numerals. This embodiment is characterized in that air from which the carrier vapor has been removed is returned into the inside of the copier.

Figure 8:
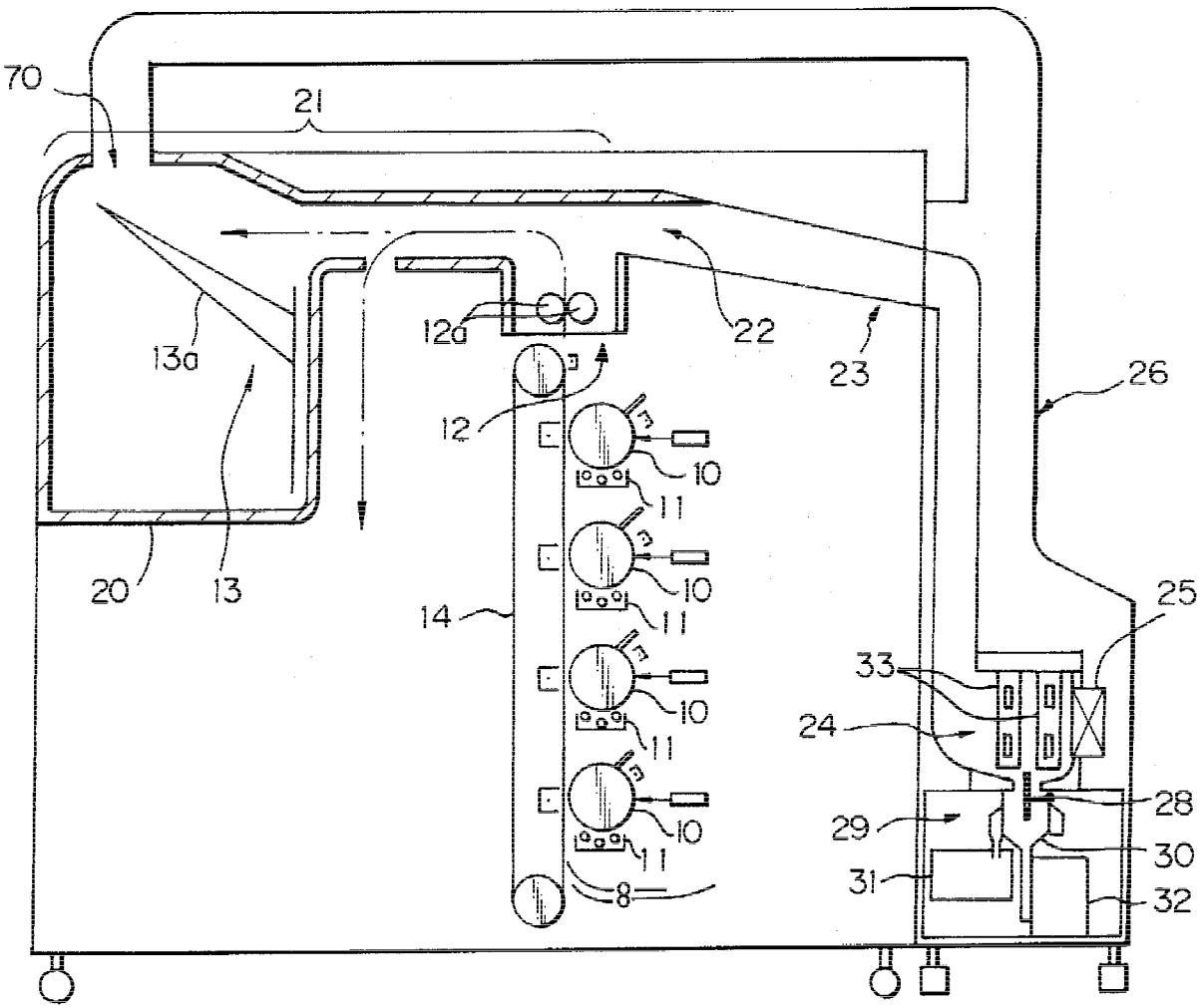
FIG. 8 is a section showing a second embodiment of the present invention.

Specifically, as shown in FIG. 8, the second duct portion 26 in which the above air flows is communicated to the chamber 21 via an inlet 70 formed in the cover 20. The chamber 21, duct portions 21, liquefying section 24 and duct portion 26 form a closed loop-like space, so that air is circulated through the space. Of course, the chamber 21 is formed with the opening for receiving the papers or copies. In a strict sense, therefore, the loop-like space is communicated to the outside.

Air flowing from the liquefying section 24 toward the duct portion 26 is free from the carrier liquid and water, i.e., dehydrated. Even if such dehydrated air is again cooled by the liquefying portion 24, almost no moisture will be collected therefrom. By returning the dehydrated air into the copier, it is possible to lower humidity in the copier efficiently, and therefore to reduce vapor contained in the air from which the carrier vapor should be collected.

Particularly, when the above air is returned into the chamber 21 which is held as hermetic as possible for the collection of the carrier vapor, vapor does not increase in amount, compared to the case wherein air is introduced into the chamber 21 from the outside of the copier. Hence, almost no moisture is introduced into the chamber 21 in a repeat copy mode, except for some moisture evaporated from papers due to fixation. As a result, the water content of the liquid collected by liquefaction is minimized. This reduces the number of times that the tank 32 should be removed from the copier in order to discard the waste water, or allows the waste water to naturally vaporize. In this manner, the separated water can be easily dealt with, so that easy maintenance is promoted.

Figure 9A:
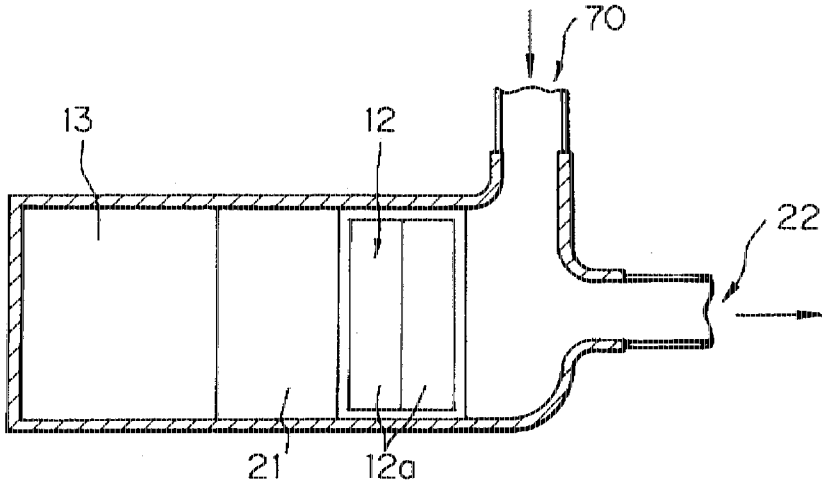
FIGS. 9A–9C each shows a particular arrangement of an air inlet and an air outlet included in the second embodiment, together with an air stream produced by the arrangement.

The air entering the chamber 21 via the inlet 70 flows toward the outlet 22. If the inlet 70 and outlet 22 adjoin each other, as shown in FIG. 9A, the air flows only between them and prevents the carrier vapor produced by fixation from being efficiently collected. Therefore, it is preferable to locate the two openings 70 and 22 at the opposite sides of the fixing device 12, as shown in FIG. 9 specifically. Desirably, the outlet 22 is located as close to the fixing device 12 as possible because the device 12 generates the greatest amount of carrier vapor.

The greatest amount of carrier vapor is produced from the paper at a position where the paper comes out of the fixing device 12, i.e., heat roller pair 12*a*. However, the carrier is continuously evaporated from the surface of the paper even after the paper has moved away from the above position. Assume that the air stream in the chamber 21 is coincident in direction with the movement of the paper. Then, the air containing a great amount of carrier vapor produced in the vicinity of the device 12 flows along the paper coming out of the device 12. As a result, the air stream obstructs the evaporation of the carrier liquid from the paper and causes the paper to be driven out while containing a great amount of carrier liquid. This lowers image quality and deteriorates paper transport.

Figure 9B:
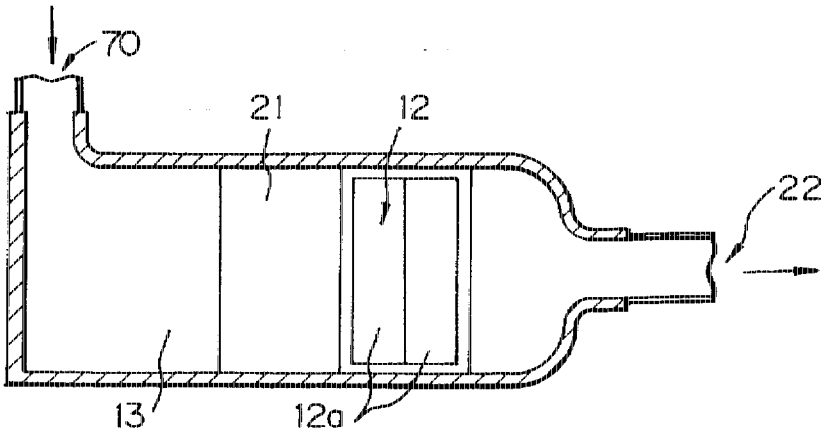

To prevent the above problem, it is preferable that the inlet 70 be located downstream of the outlet 22 with respect to the direction in which the paper is conveyed, as shown in FIG. 9B specifically. In this configuration, because the air flows from the downstream side to the upstream side with respect to the direction of paper transport, the carrier vapor produced from the paper coming out of the device 12 can be efficiently collected. This minimizes the amount of carrier liquid left in the paper or copy.

Figure 9C:
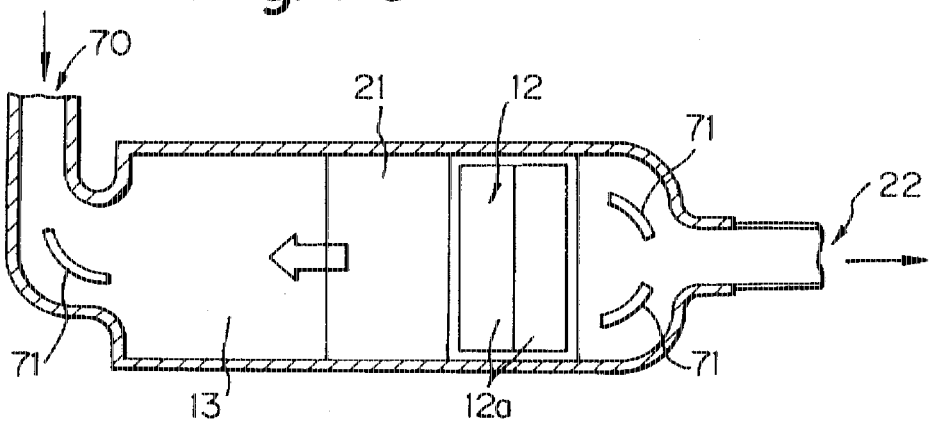

FIG. 9C show another specific configuration which is even more desirable than the configuration of FIG. 9B. As shown, the inlet 70 and outlet 22 are located at the center in the direction perpendicular to the direction of paper transport, and each is extended in the widthwise direction. A rectifying plate 71 is disposed in each of the inlet 70 and outlet 22, as needed.

The outlet 22 (FIG. 8) must be located in the vicinity of the fixing device 12 disposed in the chamber 21, so that the carrier vapor can be collected. However, this is not efficient because the air introduced into the chamber 21 has high humidity and must be liquefied later. In light of this, it is desirable to cool the conduit extending up to the fins 33 and thereby reduce the load on the cooling device. On the other hand, the air coming out of the liquefying section has low temperature due to cooling. Should the air of low temperature be returned into the chamber 21, it would lower the temperature inside the chamber 21 and would thereby bring about the dew condensation of the carrier vapor and the fall of the thermal efficiency of the fixing device 12.

The embodiment solves the above dilemma by implementing the duct portion 23 extending from the chamber 21 and the duct portion 26 extending to the chamber 21 as a double conduit. This allows heat exchange to occur between the two duct portions 23 and 26. Preferably, the wall partitioning the duct portions 23 and 26 should be made of a material whose thermal conductivity is as high as possible. In this configuration, hot air sucked from the chamber 21 and flowing through the duct portion 23 is cooled by the air flowing through the duct portion 26 which surrounds the duct portion 23. Then, the cooled air is introduced into the cooling section. Conversely, the cool air coming out of the cooling section is heated by the hot air flowing through the duct portion 23, and then returned to the chamber 21. Hence, the load on the cooling section is reduced while, at the same time, the problems ascribable to the temperature fall in the chamber 21 are eliminated. It is to be noted that the double conduit scheme for heat exchange is only illustrative.

When the cooling device for cooling and liquefying the carrier vapor is implemented by the heat radiating portion or condenser 63 (see FIG. 5) of the compressor 31, heat radiated from the portion 63 may be directly or indirectly used to raise the temperature of the cool air having undergone the cooling step. For example, the heating portion 36 may be located within the duct portion 26, or the heat of the portion 36 may be transferred by a heat pipe or similar heat transferring means. In this manner, the waste heat may be used to enhance the miniaturization and efficiency of the condenser of the cooling device.

The heat exchange based on the above double conduit scheme, and the heating of the air flowing in the duct portion 26 by the heat of the heating portion 63 may be used either singly or in combination, as desired.

While the schemes described above are practicable without resorting to an extra heat source, it is likely that the temperature of air inside the duct portion 26 changes due to, e.g., the efficiency of heat exchange. In light of this, a temperature adjusting mechanism should preferably be used in order to control the temperature of the air to be returned to the chamber 21. The mechanism may be implemented by, e.g., the combination of an electric wire heater and a thermistor or similar temperature sensing means. For example, the ON/OFF of the heater or the power applied thereto is controlled in response to the output of the temperature sensing means. This kind of mechanism is capable of controlling the temperature of the air to flow into the chamber 21. Hence, the dew condensation of the carrier vapor in the chamber 21 and ascribable to the temperature fall in the chamber 21 is prevented, and the thermal efficiency of the fixing device 12 is insured.

3rd Embodiment

This embodiment collects the carrier vapor, liquefies it, stores the resulting liquid in the carrier tank 31, and then automatically feeds it to the developing devices 11.

Figure 10:
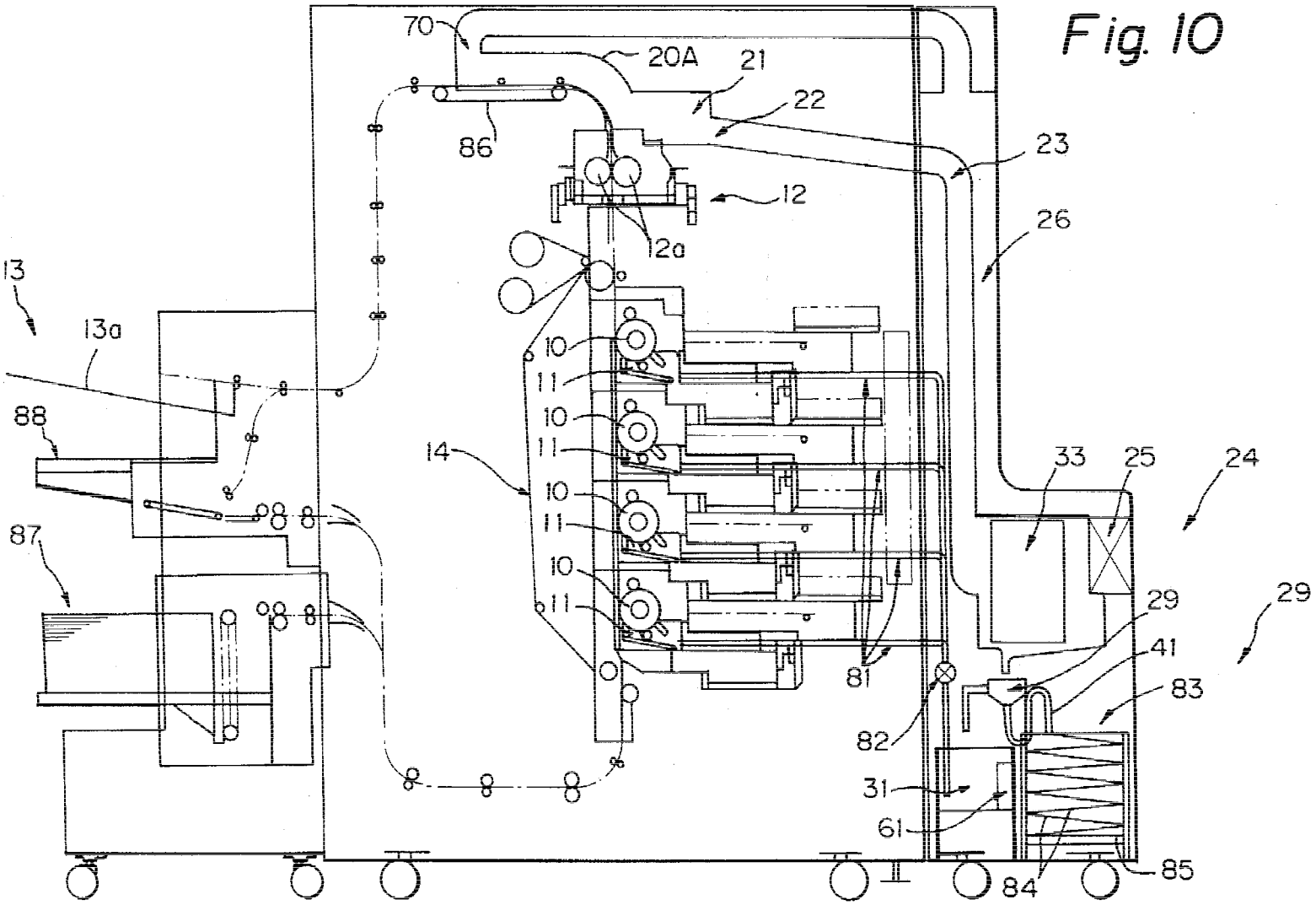
FIG. 10 is a section showing a third embodiment of the present invention.

As shown in FIG. 10, the carrier liquid produced by the liquefying section 24 and then separated from water by the separating section 29 is stored in the tank 31. A float sensor 61 senses the liquid level in the tank 31 (see also FIG. 5). When the liquid level exceeds a predetermined level, as determined by the sensor 61, a pump 82 again distributes the carrier liquid from the tank 31 to the developing devices 11 via a pipe 81.

The water separated from the carrier liquid by the separating section 29 is fed to an evaporating section 83 via the pipe 41. The evaporating section 83 has a plurality of plates 84 for evaporation which are arranged one above the other and alternately inclined in a zigzag configuration. The water is introduced into the section 83 via an opening formed in the top of the section 83. The water sequentially flowing along the plates 84 is dispersed and evaporated due to the resulting increase in surface area. A pan 85 is located at the bottom of the section 83 in order to receive the part of the water exceeding the ability of the section 83. Sensing means, not shown, is provided for sensing the full condition of the pan 85. When any error occurs in the section 83, the copier is inhibited from performing any further copying operation by sequence control. This prevents the water from leaking from the section 83. To enhance the evaporation, a heater, not shown, may be buried in each plate 84.

The duct portion 26 is communicated to the chamber 21 via the inlet 70 formed in the wall of the chamber 21, as in the second embodiment. The chamber 21, duct portion 23, liquefying section 24 and duct portion 26 form a closed loop-like space, as stated previously.

The chamber 21 is defined by a cover 20A which does not enclose the stacking device 13. Specifically, the fixing device 12 has a cover accommodating the heat roller pair 12*a* and substantially hermetically closed except for a paper inlet and a paper outlet. The cover 20A is positioned above the paper outlet of the device 12 and has the previously stated outlet for the air containing the carrier vapor, and an opening facing the upper surface of a belt included in a conveyor belt assembly 86. The belt assembly 86 conveys a paper coming out of the device 12 toward the tray 13*a* included in the stacking device 13.

In this embodiment, a paper feed unit 87 is disposed below the stacking device 13 in order to sequentially feed papers toward the drum 10. A turning section 88 for a duplex copy mode is interposed between the paper feed unit 97 and the stacking device 13.

As stated above, the embodiment automatically distributes the carrier liquid collected in the tank 31 to the developing devices 11 as a recycled carrier liquid. This not only obviates the need for manual work relating to the recycling of the collected carrier liquid, but also increases the interval between the consecutive replenishments of the developer to the developing devices 11.

Figure 11:
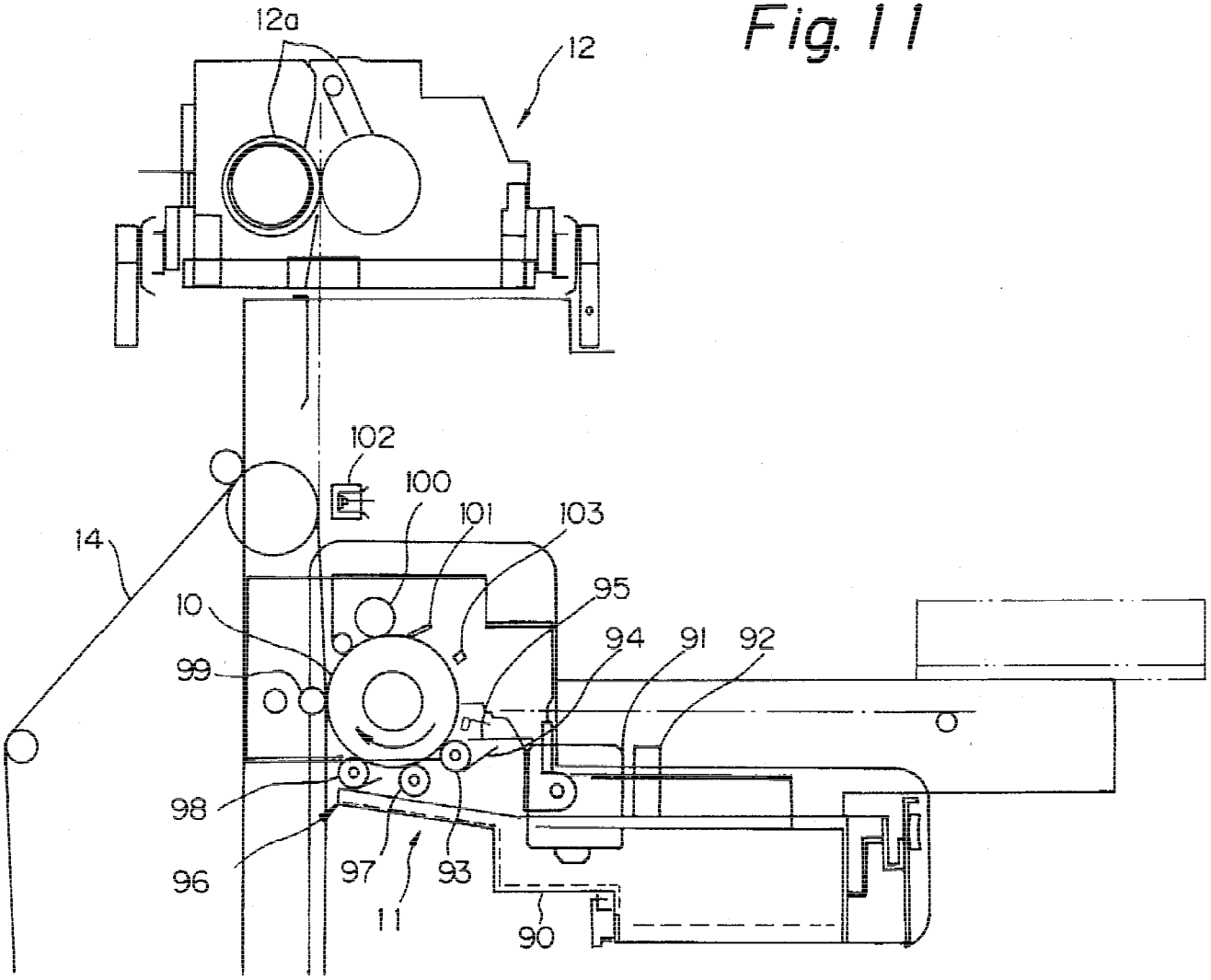
FIG. 11 is a section showing a carrier vapor collecting device included in accordance with the third embodiment.

Generally, in the wet process copier, each developing device 11 is supplied with the carrier liquid from a supply tank as the developer is consumed. For example, as shown in FIG. 11, the developing device 11 has a pan extending to a position beneath the drum in order to collect the liquid. A supply tank 91 stores a carrier liquid to be replenished into a developing tank 90 storing the carder liquid and toner, i.e., the developing liquid.

In the color copier having the developing devices 11 each being assigned to a particular color, the consumption of the developer differs from one device 11 to another device 11. Hence, the time for replenishing the carrier liquid to the developing device 11 depends on the color. In light of this, the supply tank 91 associated with each developing device 11 should preferably be provided with a sensor 92 for sensing the amount of the carrier remaining in the tank 91. Then, it is possible to find the developing device 11 whose supply sank 91 is short of the carrier liquid, and deliver the collected or recycled carrier liquid thereto. For this purpose, the pump 82 and pipe 81 shown in FIG. 10 may be assigned to the individual developing device 11. In such a case, the pumps 82 will be selectively operated independently of each other.

In an alternative arrangement, the pipe 81 is provided with branching ends each terminating at one of the developing units 11, and the pump 82 is provided at the other end of the pipe 81. A single solenoid-operated valve is interposed between the pump 82 and the branching ends of the pipe 81 so as to selectively communicate one of the branching ends to the pump 82. In this configuration, the valve is controlled to selectively supply the carrier liquid to the developing units 11. This balances the time for replenishing the carrier liquid throughout the developing units 11, and thereby facilitates maintenance. The above control is executed by a controller, not shown, capable of receiving the output of the sensor 92 as well as other signals.

In the color copier, the developing devices 11 usually store a black developer, magenta developer, cyan developer, and yellow developer, respectively. The black developer is consumed more than the others because text images are mostly black. In this case, the recycled carrier liquid may be fed only to the developing device 11 which consumes the developer (black) more than the others. This is comparable in effect with the above arrangement which senses the developer consumption device by device. Further, by feeding the recycled carrier liquid only to the limited developing device 11, it is possible to reduce the number of pipings and pumps and thereby miniaturize the copier. In addition, the probability of leakage and other troubles is reduced, so that the reliability of the copier is enhanced.

If desired, the piping from the carrier tank 31 to the developing device 11 may be so arranged as to be switched by hand. Then, the operator can select and set the color to be consumed most in matching relation to desired printings.

4th Embodiment

This embodiment is characterized in that desirable images are achievable without regard to the kind of a paper of similar recording medium.

It is difficult with a conventional wet process copier to produce attractive images when the kind of a recording medium is changed, as will be described hereinafter. The following description will compare a fine paper and a coated paper by way of example. Fine papers are extensively used with a copier, facsimile apparatus or similar image forming apparatus, while coated papers are provided with coatings thereon for enhancing whiteness and smoothness.

A fine paper and a coated paper differ from each other in surface configuration. Specifically, FIGS. 12A and 12B respectively show fibers appearing on the surface of a fine paper, and fibers appearing on the surface of a coated paper. FIGS. 13A and 13C respectively show the surface configuration of the fine paper and that of the coated paper. FIG. 13B shows the surface configuration of a slightly coated paper smaller in the amount of a coating agent than the coated paper.

Figure 12A:
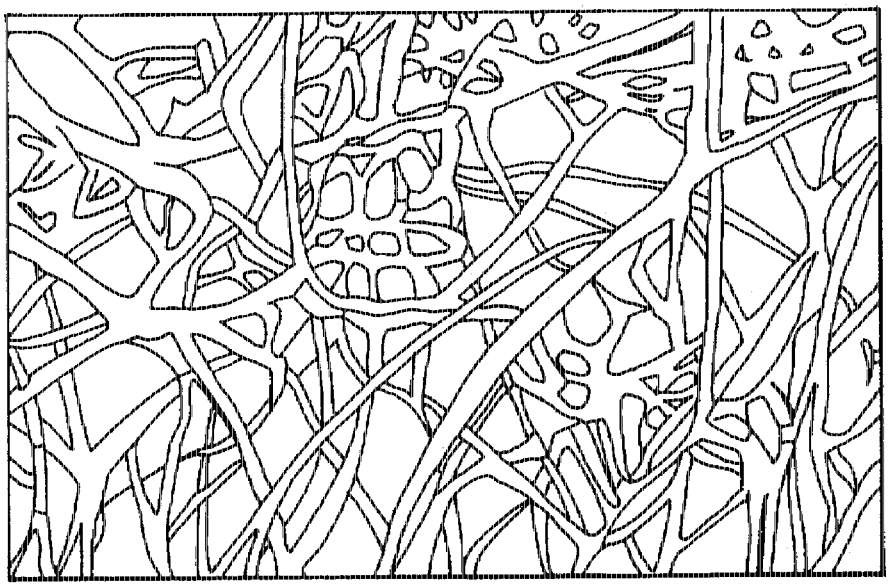
Fig. 12A PRIOR ART
FIGS. 12A and 12B respectively show fibers appearing on the surface of a conventional fine paper and fibers appearing on the surface of a conventional coated paper.
Figure 12B:
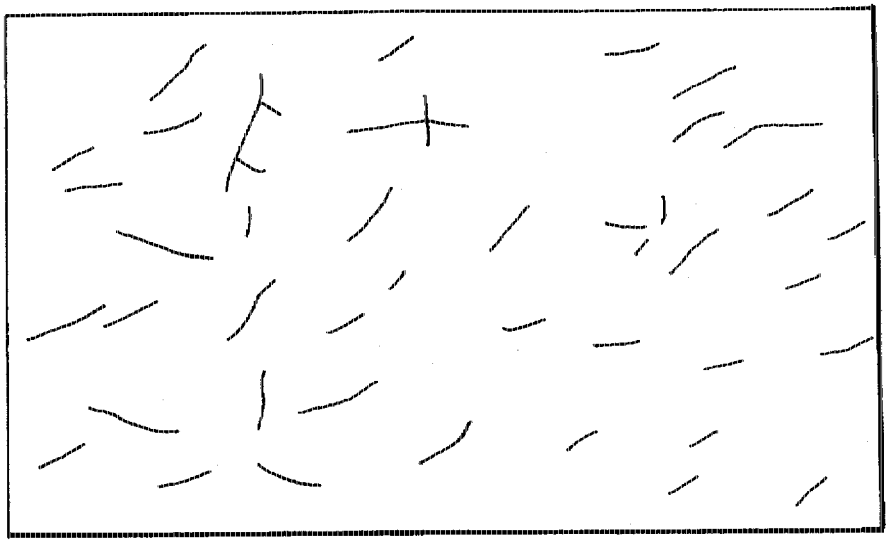
Fig. 12B PRIOR ART

As FIGS. 12A and 13A indicate, the fibers on the surface of the fine paper are exposed to the outside, and have irregularities exceeding 10 μm (P-V value). By contrast, FIGS. 12A and 13C indicate that the coated paper has a smooth surface because it is coated with a coating agent; irregularities are less than 2 μm. As shown in FIG. 13B, the slightly coated paper has irregularities intermediate between the irregularities of the fine paper and those of the coated paper. Generally, therefore, recording media applicable to image forming apparatuses have surface irregularities ranging from 2 μm to 10 μm.

FIGS. 14A and 14B respectively show how a toner image is transferred from a photoconductive element or similar image carrier 10 to a fine paper S2, and how it is transferred to a coated paper S1. The image carrier 10 has a base 10*a* made of aluminum, and a photoconductive layer 10*b* formed on the base 10*a*. A toner image is formed on the image carrier 10 by a developing device. As shown in FIG. 14B, the gap between the coated paper S1 and the image carrier 10 is filled with a sufficient amount of carrier liquid 105 because the irregularities of the paper S1 are less than 2 μm. The electrophoresis of toner particles is promoted in the carrier liquid 105, so that the toner image can be desirably transferred to the paper S1. By contrast, as shown in FIG. 14A, bores where the carrier liquid 105 is absent occur between the fine paper S2 and the image carrier 10, obstructing the electrophoresis of toner particles. This results in a defective image on the paper S2.

In the above example, the amount of carrier liquid for image transfer and an electric field for electrophoresis are so adjusted as to effect desirable image transfer when the coated paper S1 is used; image transfer is defective when the fine paper S2 is used. On the other hand, if the above factors are so adjusted as to effect desirable image transfer when the fine paper S2 is used, the image quality is lowered when the coated paper S1 is used; the carder liquid 105 is fed to the gap between the coated paper S1 and the image carrier 10 in an excessive amount, i.e., in an amount assigned to the fine paper S2.

As stated above, the surface configuration of a recording medium depends on the kind of the medium, and has influence on the transfer of toner particles. This is why the conventional copier of the kind concerned fails to form an attractive image without regard to the kind of recording medium.

Figure 15:
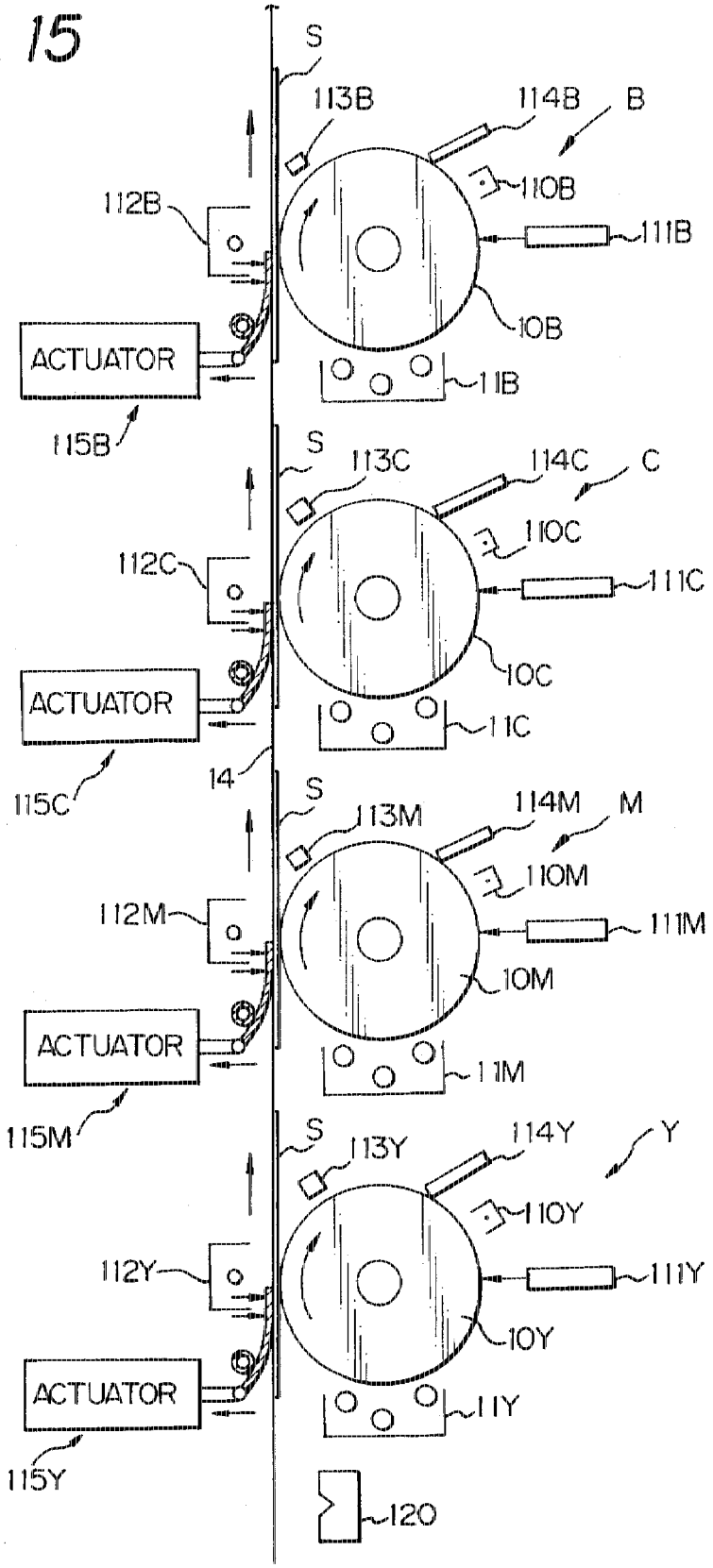
FIG. 15 is a front view showing a fourth embodiment of the present invention.

Referring to FIG. 15, the embodiment is implemented as a copier having a conveyor unit including an image transfer belt 14. The conveyor unit conveys a recording medium or paper S from a lower portion to an upper portion within the copier. A yellow (Y) toner image forming unit, a magenta (M) toner image forming unit, a cyan (C) toner image forming unit and a black (B) toner image forming unit are arranged in the vicinity of the belt 14, and respectively store a Y toner, an M toner, a C toner, and a B toner.

The Y, M, C and B toner image forming units will be described specifically. Because all the units have an identical construction, let the following description concentrate on the Y unit by way of example. In the other units, the constituents corresponding to the constituents of the Y unit are distinguished by suffixes M, C and B added to the reference numerals.

The Y toner image forming unit has a photoconductive drum 10Y. Arranged around the drum 10Y are a charger 110Y, an exposing device 111Y, a developing device or developing means 11Y, an image transferring device or transferring means 112Y, a discharger 113Y, a cleaning device 11Y, and a pressing device or pressing means 115Y. The developing device 11Y uses a two-ingredient type developer consisting of a carrier liquid and a toner dispersed therein. The transferring device 112Y is implemented by a charger for causing the electrophoresis of toner particles to occur from the drum 10Y to the paper S, so that the toner is electrostatically deposited on the paper S.

Figure 16:
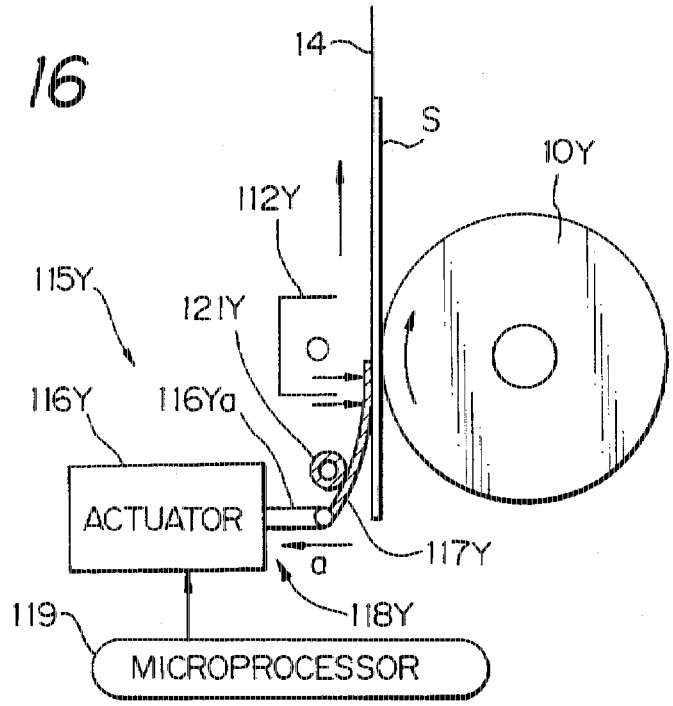
FIG. 16 is a fragmentary view of the fourth embodiment.

FIG. 16 shows the pressing device 115Y specifically. As shown, the device 115Y presses the paper S against the drum 10Y with the intermediary of the belt 14. The device 115Y has a solenoid or similar actuator 116Y, a presser plate 117Y, and a transfer mechanism 118Y for transferring the force of the actuator 116Y to the presser plate 117Y. The actuator 116Y and transfer mechanism 118Y constitute a pressing mechanism for pressing the paper or recording medium S and the drum or image carrier 10Y against each other. A microprocessor or control means 119 controls the pressure for pressing the paper S against the drum 10Y. The microprocessor 119 stores a conversion table listing the kinds of papers S usable with the copier, and optimal pressures respectively associated with the kinds of the papers S. When a sensor or transferring means 120 (see FIGS. 15 and 17), which will be described, informs the microprocessor 119 of the kind of the paper S used, the microprocessor 119 looks up the table to select the pressure matching the paper S, and then controls the pressing device 115Y. Specifically, the microprocessor 119 determines a displacement of an arm 116Y*a* included in the actuator 116Y in a direction indicated by an arrow a in FIG. 16. The presser plate 117Y is formed of a flexible material and affixed to the free end of the arm 116Y*a*. When the arm 116Y*a* is moved in the direction a, the flexible presser plate 117Y is deformed while being supported by a shaft 121Y. As a result, the end of the presser plate 117Y remote from the arm 116Y*a* presses the paper S against the drum 10Y.

Figure 17:
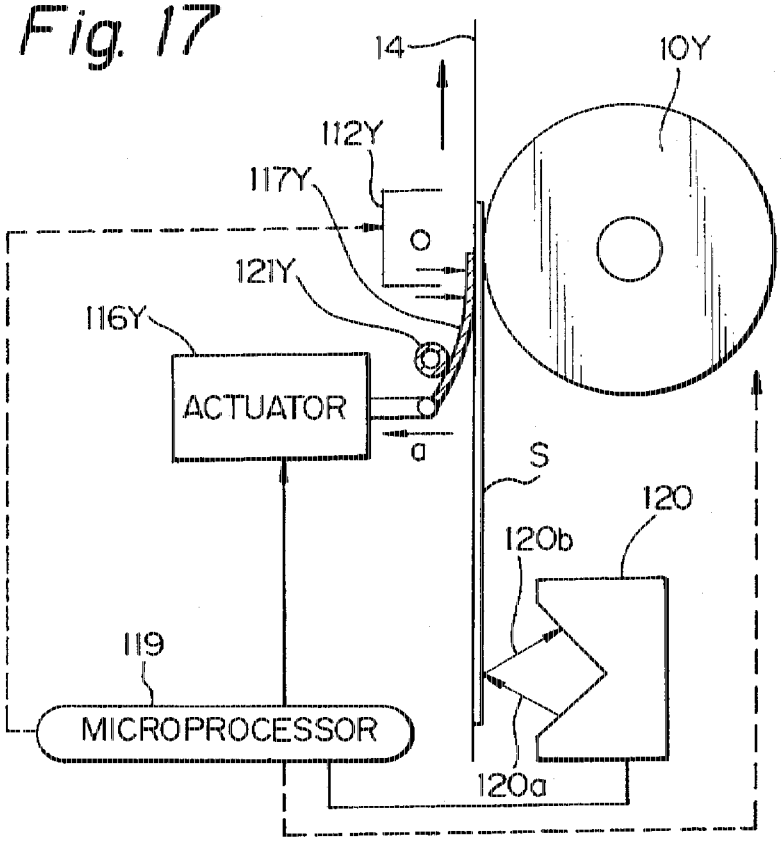
FIG. 17 shows the function of a sensor included in the fourth embodiment.

As shown in FIG. 17, the previously mentioned sensor 120 is positioned upstream of the image forming unit Y with respect to the running direction of the belt 14, and in the vicinity of the surface of the belt 14 which electrostatically retains the paper S thereon. The sensor 120 emits light 120*a* toward the paper S, receives the resulting reflection 120*b* from the paper S, and then determines the kind of the paper S on the basis of the reflection 120*b*. Specifically, the sensor 120 determines the gloss of the paper S on the basis of the diffused light included in the reflection 120*b*, and determines the thickness of the paper S on the basis of the image position and focus point.

In the above construction, the belt 14 electrostatically retaining the paper S thereon conveys it from the lower portion to the upper portion of the copier at the same peripheral speed as the drums 10Y, 10M, 10C and 10B. The various process units arranged around the drum 10Y, as stated earlier, form a yellow toner image on the drum 10Y. Specifically, as shown in FIG. 15, the charger 110Y uniformly charges the surface of the drum 10Y. The exposing device 111Y electrostatically forms a latent image on the charged surface of the drum 10Y. The developing device 11Y develops the latent image with the yellow toner to thereby form a yellow toner image. The image transferring device 112Y transfers the yellow toner image to the paper S. More specifically, the device 112Y forms an electric field in the gap between the drum 10Y and the paper S and filled with the carrier liquid. As a result, the yellow toner which is charged is transferred from the drum 10Y to the paper S by electrophoresis. At this instant, the paper S is pressed against the drum 10Y by the pressing device 115Y under an optional pressure matching the kind of the paper S. Hence, an optimal amount of carrier liquid matching the kind of the paper S exists between the paper S and the drum 10Y. This prevents defective image transfer due to the short carrier liquid, and the defacing of an image due to the excessive carrier liquid.

The belt 14 sequentially conveys the paper S carrying the Y toner image thereon to the the M, C, B image forming units. The M, C and B units respectively transfer an M toner image, a C toner image, and a B toner image to the paper S. That is, the M, C and B toner images are sequentially superposed on the Y toner image existing on the paper S, thereby completing a color image. The operations of the M, C and B units will not be described because they are identical with the operation of the Y unit.

In the above procedure, it is preferable that the pressure pressing the paper S against the drum 10 be sequentially reduced as the transfer of the toner image to the same paper S is repeated. That is, the pressures to be exerted by the pressing devices 115Y, 115M, 115C and 115B should preferably be sequentially reduced in this order for the following reason. Every time the toner image transferred to the same paper S, the carrier liquid deposits on the surface of the paper S. As a result, the amount of toner existing in the gap between the drum 10 and the paper S sequentially increases. Hence, the pressure required to fill up the gap with the developer sequentially decreases. This successfully prevents an occurrence that the toner image on the paper S is displaced and defaced due to an excessive pressure.

The presser plates 117 and belt 14 should preferably be formed of a conductive material. Specifically, it is preferable that each presser plate 117 be formed of a material whose resistance is about $10^{10}$ Ωcm, and the belt 14 is formed of a material whose resistance is about $10^{8}$ Ωcm to $10^{12}$ Ωcm. In this condition, if the presser plate 117 is connected to ground, the potential of the belt 14 connected to ground via the plate 117 can be prevented from increasing; an increase in potential would lower the transfer efficiency, thereby lowering the image quality. Alternatively, the presser plate 117 may be connected to a preselected DC or AC power source for discharging. In addition, the presser plate 117 may advantageously be formed of a material having a small coefficient of friction, e.g., fluorine-containing resin in order to enhance durability.

A lamp, heater or similar heating means, not shown, should preferably be provided in the copier for heating the respective presser plate 117. When the presser plate 117 heated by the heating means presses the paper S against the drum 10, the paper S is heated with the result that the viscosity of the carrier liquid deposited decreases and, therefore, the viscosity of the toner layer decreases. Hence, the toner easily penetrates into the fibers of the paper S, i.e., the toner transfer efficiency is enhanced.

Figure 18:
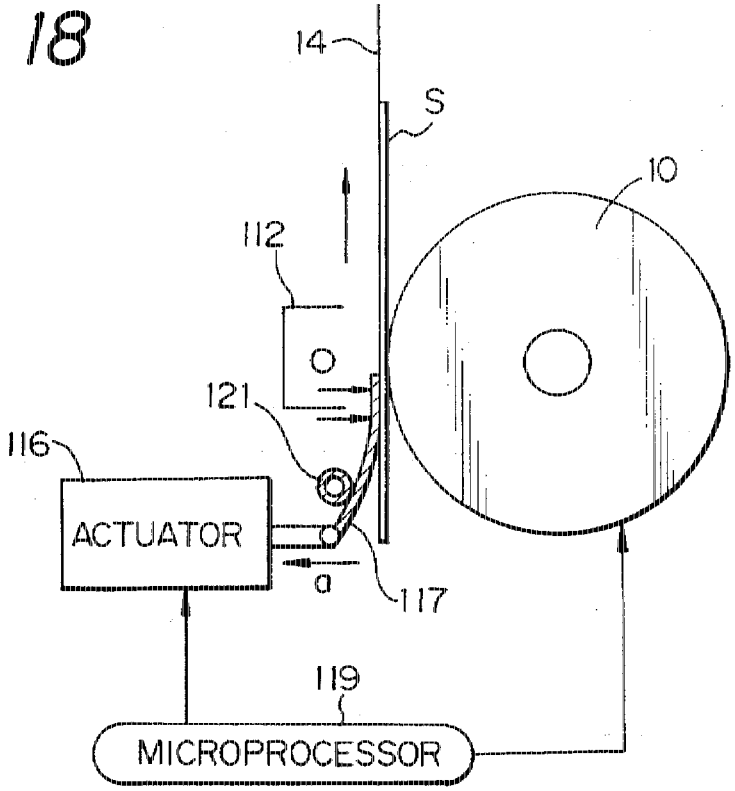
FIGS. 18–22 respectively show a first to a fifth modification of the fourth embodiment.

It is preferable to control the amount of toner deposited on the drum 10 in addition to the control over the pressure for pressing the paper S against the drum 10. Specifically, when the paper S is of the kind with which toner transfer is not easy, it is preferable to increase the amount of toner deposited on the drum 10 while increasing the pressure exerted by the pressing device 115. On the other hand, when the paper S is of the kind with which toner transfer is easy, it is preferable to reduce the amount of toner deposited on the drum 10 while reducing the pressure of the device 115. More specifically, as shown in FIG. 18, the microprocessor 119 controls the amount of toner deposition by adjusting the amount of charge deposited on the drum 10. The microprocessor 119 may control, in place of the amount of charge, a bias to be applied to the developing unit 11, the amount of the developer to be fed to the drum 10, or the density of the developer. This kind of scheme broadens the range of paper types usable by to the copier.

Figure 19:
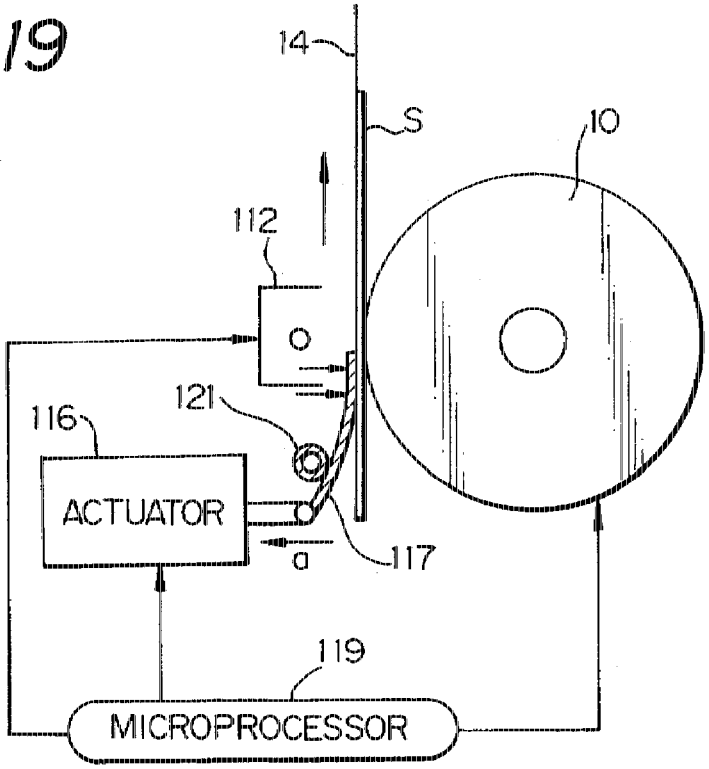

It is preferable to control the electric field for image transfer formed by each transferring device 112, while controlling the pressure for pressing the paper S against the drum 10, as stated above. Specifically, when the paper S has a relatively rough surface with which toner transfer is not easy, it is preferable to intensify an electric field for causing toner to move toward the paper S by electrophoresis, while increasing the pressure. When the paper S has a relatively smooth surface with which toner transfer is easy, it is preferable to intensify an electric field for causing the toner to move toward the drum 10 by electrophoresis, while lowering the pressure. More specifically, as shown in FIG. 19, the microprocessor 119 controls the electric field by adjusting the transferring device 112. It is to be noted that FIG. 19 shows the case wherein the amount of toner deposition on the drum 10 is controlled also.

Figure 20:
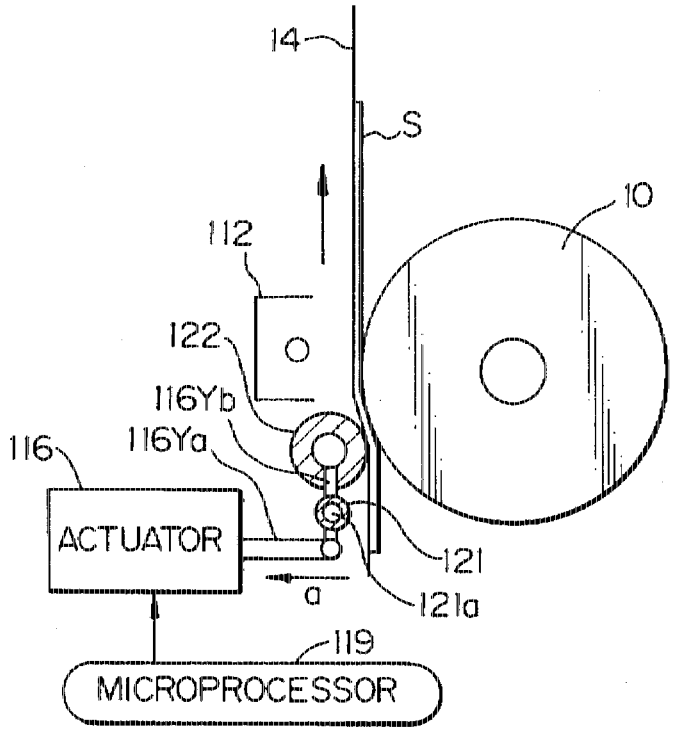

As shown in FIG. 20, the presser plate 117 may be replaced with a roller 122. When the roller 122 is used, a second arm 116Y*b* is connected to the free end of the arm 116Y*a* of the actuator or solenoid 116. When the arm 116Y*a* is moved in the direction a, the arm 116*b* is rotated about a shaft 121*a* so as to press the paper S against the drum 10. Because the friction acting between the roller 122 and the belt 14 is small, the force required to drive the belt 14, i.e., the paper S is reduced. In addition, the durability of the pressing member and belt 14 is enhanced.

When the copier uses a roller charge scheme for forming the electric field for image transfer, the above roller 112 may be implemented by a charge roller. This reduces the number of parts and simplifies the structure of the copier. The pressing member may be comprised of a brush member, if desired. The brush member sets up a uniform pressure distribution in the lengthwise direction more easily than the presser plate 117. On the other hand, the presser member 117 is inexpensive and reduces the production cost of the copier. It is desirable with the roller 122 or the brush member, as with the presser plate 117, to use a conductive material having a small coefficient of friction.

Figure 22:
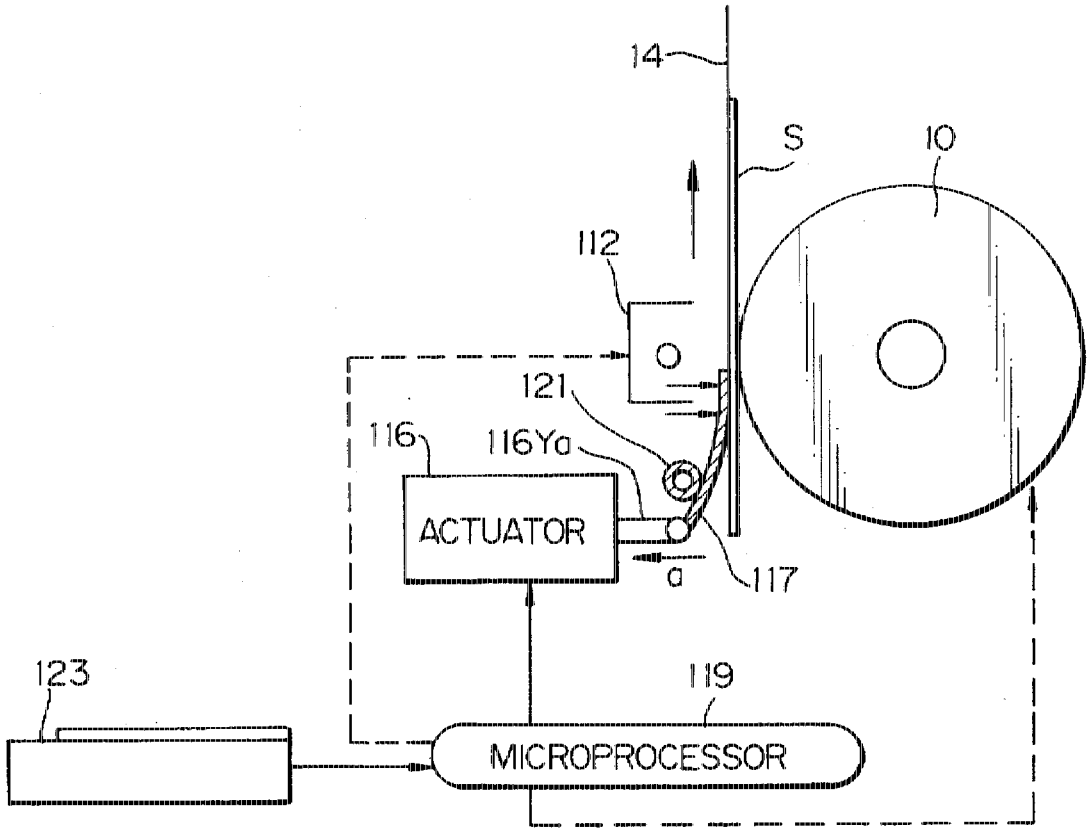

In the embodiment, the sensor 120 plays the role of the transferring means for informing the microprocessor 119 of the kind of the paper S. Alternatively, as shown in FIG. 22, the papers S of particular size may be loaded in a cassette 123 exclusively assigned thereto. Then, the transferring means identifies the cassette 123 and then informs the microprocessor 119 of the kind of the papers S. For example, such cassettes 123 may be provided with lugs at different positions, in which case the copier body will be provided with switches to be respectively actuated by the lugs. Then, it is possible to identify the cassette 123 and the kind of papers S stored therein by determining which of the switches is pressed.

Further, the transferring means for informing the microprocessor 119 of the kind of the paper S may be implemented as switches arranged on the operation panel of the copier. In this case, the operator will operate the switches on the basis of the kind of the papers S and thereby report it to the microprocessor 119.

Figure 21:
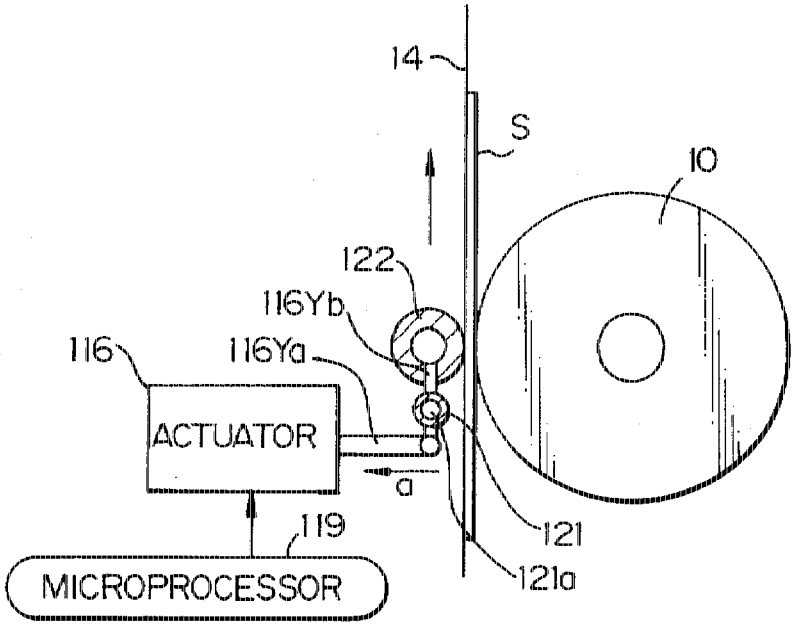

Assume that at the position where the paper S contacts the drum 10, an electrode member contacts the rear of the belt 14 in order to form an electric field for image transfer, as in the charge roller scheme shown in FIG. 21. Then, discharge occurs between the electrode member and the rear of the belt 14 at a position upstream, in the paper transport direction, of the position where the electrode member and belt 14 contact each other. The resulting electric field is apt to cause the toner to move from the drum 10 to the paper S when the paper S is not sufficiently close to the surface of the drum, resulting in a defective image. This kind of defective image also occurs even when the charge roller does not play the role of the pressing member, i.e., when a conventional charge roller is used.

Figure 23:
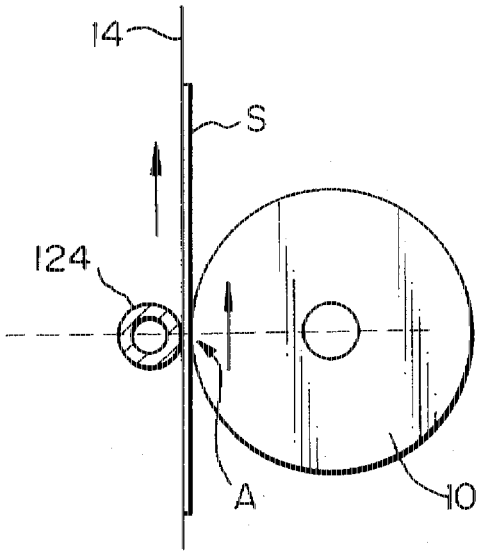
FIG. 23 shows an image transferring device using a charge roller.

For example, as shown in FIG. 23, assume that the image transferring device 112 uses a charge roller 124. Then, if the voltage applied to the charge roller 124 is about 1 kV, discharge occurs at a position about 1 mm upstream of the point A of the roller 124 contacting the rear of the belt 14 with respect to the paper transport direction. If the voltage is higher than 3 kV, discharge occurs at a position about 3 mm upstream of the point A with respect to the above direction. At the position spaced about 1 mm from the point A, the paper S and the surface of the drum 10 are sufficiently close to each other, so that the discharge is acceptable and does not disturb the image. However, the discharge occurring at the position spaced about 3 mm from the point A causes the toner to move and thereby disturbs the image because the paper. S and the surface of the drum 10 do not contact each other.

Figure 24A:
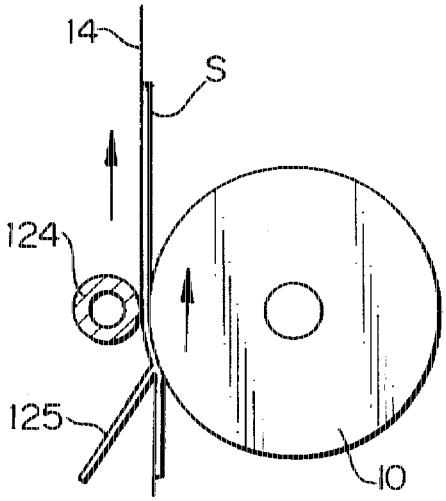
FIGS. 24A and 24B each shows a specific configuration for obviating disturbance to an image.
Figure 24B:
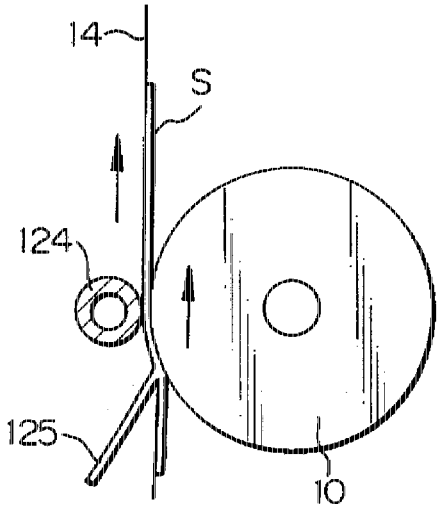
Figure 25A:
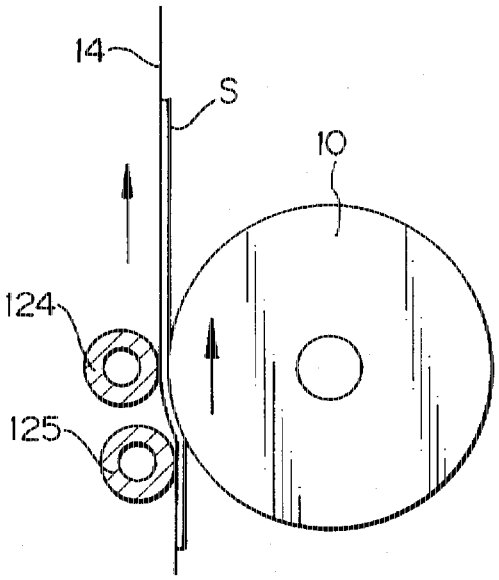
FIGS. 25A–25C each shows another specific configuration for obviating disturbance to an image.
Figure 25B:
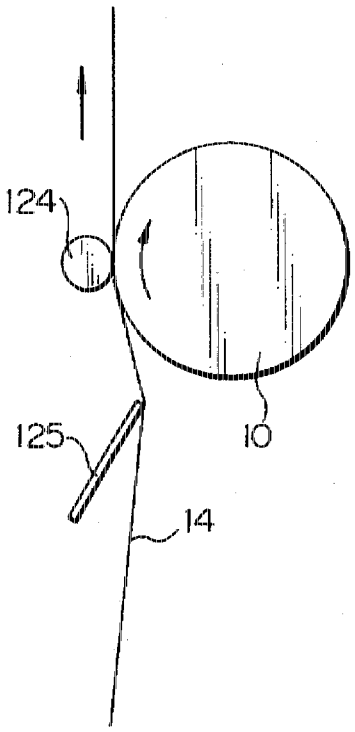

A reference will be made to FIGS. 24A, 24B and 25A--25C for describing specific implementations for preventing the above disturbance to the image in relation to the charge roller 124. FIGS. 24A, 24B, 25A and 25B each shows a support member 125 located at the position upstream of the point A of the roller 124 and where discharge is apt to occur between the roller 124 and the rear of the belt 14. As shown, the support member 125 supports the belt 14 in such a manner as to press the rear of the belt 14 toward the drum 10, so that the paper S on the belt 14 can substantially contact the surface of the drum 10. As shown in FIGS. 24A, 24B and 25A, the support member 125 may support the belt 14 at a position where it faces the drum 10 with the intermediary of the belt 14. Alternatively, as shown in FIG. 25B, the support member 125 may do so at a position where it does not face the drum 10.

The support member 125 may be implemented as a plate, as shown in FIG. 24A, or as a roller, as shown in FIG. 25A. Each specific configuration of the support member 125 has the advantage previously stated in relation to the presser plate 117, roller 122, or brush member. To provide the support member 125 with a discharging function, the member 125 may be formed of a conductive material, or connected to ground, or connected to a DC or AC power source. Then, when the paper S carried on the belt 14 is passed through a plurality of image transfer stations, as shown in FIG. 15, the above discharging function will reduce the required increment of electric field at each transfer station. In addition, the support member 125 may be formed of fluorine-containing resin or similar material having a small coefficient of friction.

Figure 25C:
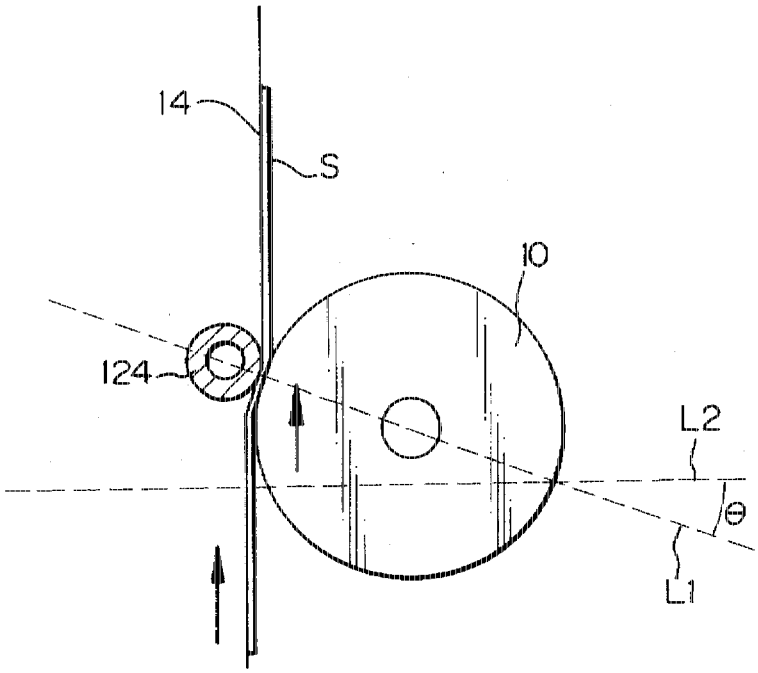

In FIG. 25C, the charge roller 124 is positioned such that the belt 14 wraps around the drum 10 in a predetermined amount up to the point A of the charge roller 124. Specifically, assume a line L1 connecting the center of the charge roller 124 and that of the drum 10, and a line L2 perpendicular to the transport direction of the paper S up to the drum 10. Then, the charge roller 124 is positioned such that the lines L1 and L2 make an angle θ therebetween. The angle θ is selected such that the paper S on the belt 14 substantially contacts the surface of the drum 10 at the position where discharge is apt to occur between the roller 12 and the rear of the belt 14. If the angle θ is excessively great, it is likely that the paper S is excessively bent at opposite sides of the charge roller 124 in the transport direction. As a result, the paper S is apt to jam the transport path. The angle θ should preferably be less than 5 degrees inclusive in order to prevents the disturbance to the image while insuring an acceptable degree of paper transporting ability. Table 1 shown how the image quality and paper transporting ability change with changes in the angle θ, as determined by experiments. In Table 1, the word "upstream" refers to a condition wherein the charge roller 124 is shifted to the upstream side in the paper transport direction such that the belt 14 starts wrapping around the drum 10 at a position where the roller 124 faces the drum 10, i.e., a condition opposite to the condition shown in FIG. 25C.

TABLE 1

| | θ | | | | | | |
|---|---|---|---|---|---|---|---|
| Item | Up - stream 8° | Up - stream 5° | Up - stream 2° | Fac- ing 0° | Down - stream 2° | Down - stream 5° | Down - stream 8° |
| Image quality | X | X | Δ | Δ | ○ | ○ | ○ |
| Paper Trans- port | ○ | ○ | ○ | ○ | ○ | Δ | X |

As Table 1 indicates, both the image quality and the paper transport are desirable when the angle θ is 2 degrees or 5 degrees at the downstream side in the paper transport direction.

The support member 125 shown in any one of FIGS. 24A, 24B, 25A and 25B may also be displaced by, e.g., the solenoid 116 or the drive transferring means 118 in order to change the pressure. This also successfully changes the pressure in matching relation to the kind of the paper S and thereby prevents, e.g., defective image transfer and defacing.

Figure 26A:
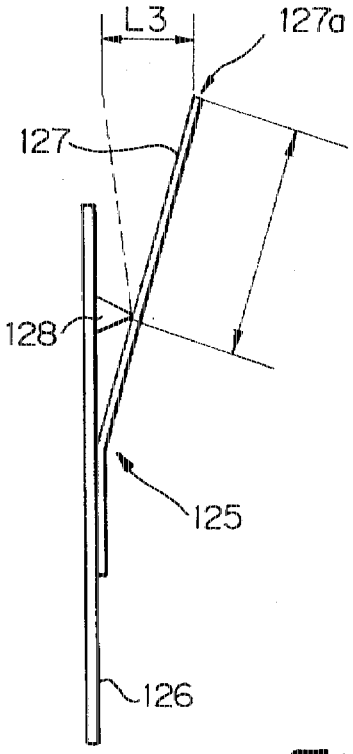
FIG. 26A shows a support member used for experiments.
Figure 26B:
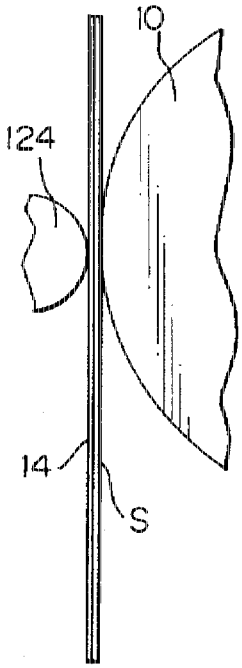
FIG. 26B shows an image transfer position where the support member is absent.
Figure 26C:
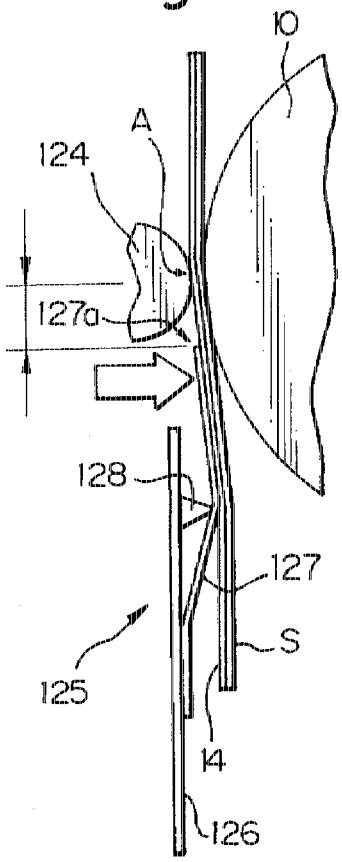
FIG. 26C shows an image transfer position where the support member is present.

Hereinafter will be described the results of experiments conducted to determine the disturbance to the image with the flat support member 125 shown in FIG. 24A. FIG. 26A shows the support member 125 used for the experiments. FIGS. 26B and 26B respectively show the image transfer position where the support member 125 is absent, and the image transfer position where it is present. As shown, the support member 125 has a stay 126 affixed to the copier body, and a 200 μm thick presser plate 127 formed of polyester resin and affixed to the stay 126. As shown in FIG. 26C, the presser plate 127 presses the belt 14 against the drum 10 while deforming itself. A laminate of a plurality of presser plates 127 may be affixed to the stay 126 in order to intensify the pressure. Specifically, the presser plate 127 is affixed to the stay 126 at its rear end portion. The intermediate portion of the plate 127 in the lengthwise direction rests on a fulcrum 128 protruding from the stay 126. The front end or free end portion of the plate 127 extending over the fulcrum 128 is 20 mm long and deformable to exert the expected pressure.

A series of experiments were conducted in order to evaluate transferred images under four different conditions listed in Table 2, and three different conditions listed in Table 3. Table 2 shows four different distances of the end 127*a* of the presser plate 127 from the point A of the roller 124, and the resulting deformations L3 of the end portion of the plate 127. Table 3 shows three different numbers of the plates 127 and the resulting pressures. It is to be noted that for each condition shown in Table 1, use was made of two presser plates 127 stacked together. The deformation and, therefore, the pressure changes from one condition to another condition. The results shown in Table 3 were determined in a condition wherein the plate 127 had the end portion deformable by 8 mm and had the end 127*a* spaced 7 mm from the point A of the roller 124.

TABLE 2

| End Position (mm) | 5 | 7 | 10 | 13 |
|---|---|---|---|---|
| Deformation (mm) | 8.5 | 8 | 7.5 | 5 |

TABLE 3

| Number of Plates | 1 | 2 | 3 |
|---|---|---|---|
| Pressure/gf | 330 | 510 | 770 |

Under the above conditions, transfer samples were produced with digital sixteen tones and lattice pattern, and evaluated as to faithfulness, glance image quality, and (ID). As to faithfulness, a microscope and five-state organoleptic test were used. Specifically, the samples were evaluated as to the tones 1, 10 and 15 and the lattice, and their mean values were produced. Regarding ID, a densitometer available from X-Rite was used, and a solid portion was evaluated in terms of a three-point mean value. To produce the samples, the transferring device 112 was implemented by a system using a charge roller 112A shown in FIGS. 26B and 26C. Also, use was made of the uppermost or B developing device 11B and including the support member 125, and the uppermost drum 10B. Image forming conditions (i.e., specifications assigned to the copier are as follows:

| | |
|---|---|
| B toner concentration | 40 g/liter |
| developer temperature | 25° C. to 30° C. |
| drum | rough surface drum |
| developing roller speed | 150 rpm |
| squeeze roller speed | 100 rpm (linear velocity ratio of 3.0) |
| developing bias | 300 V |
| set roller gap | 80 μm |
| set roller voltage | −1.1 kV |
| belt material | PET (polyethylene terephthalate) |

Figure 27A:
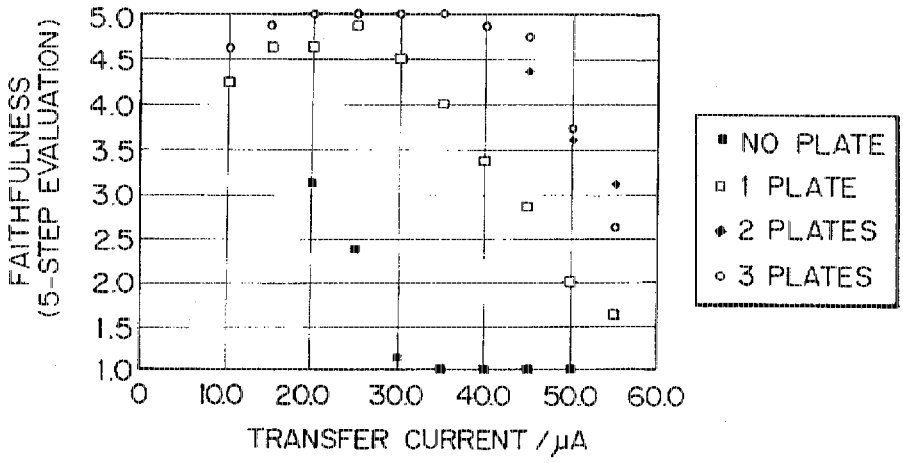
FIGS. 27A–27C and 28A–28C are graphs showing the results of the experiments.
Figure 27B:
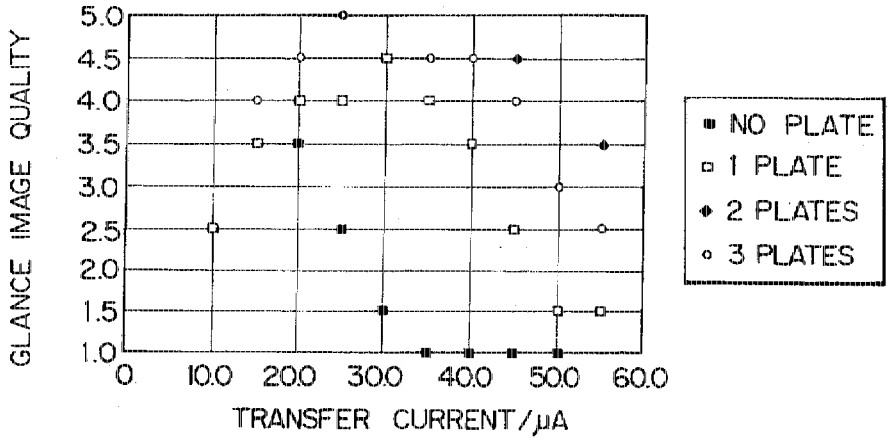
Figure 27C:
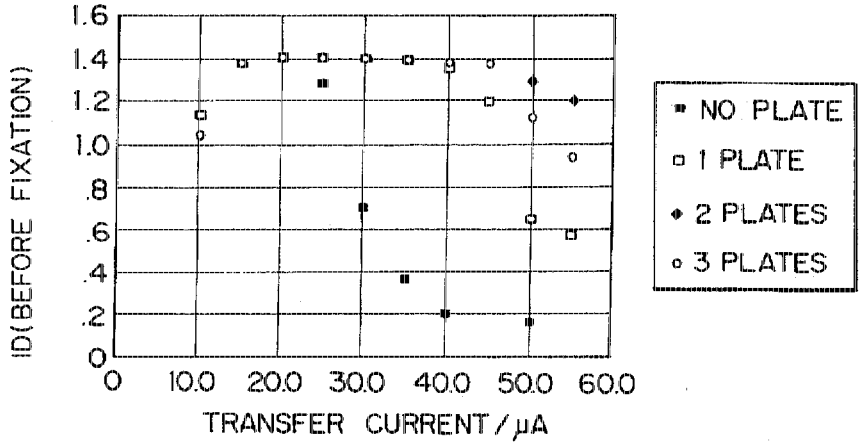
Figure 28A:
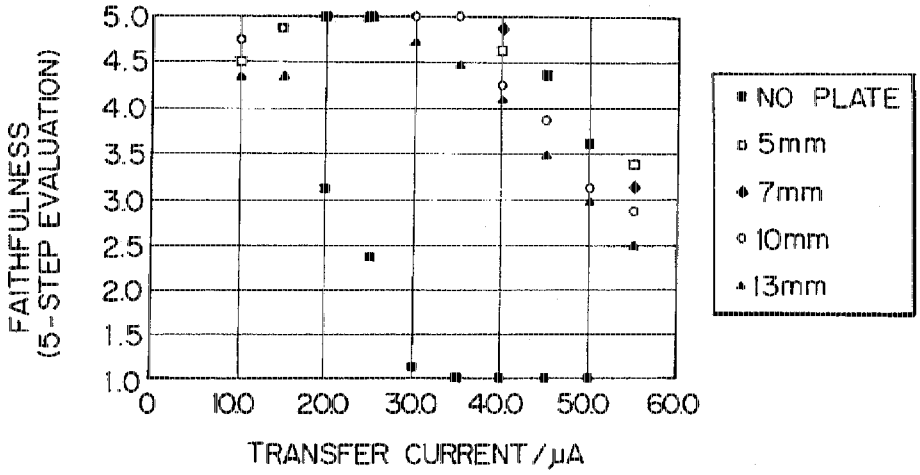
Figure 28B:
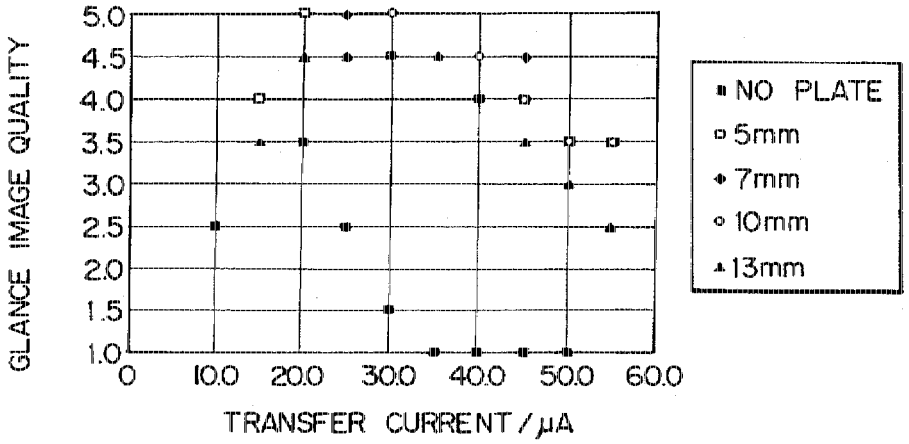
Figure 28C:
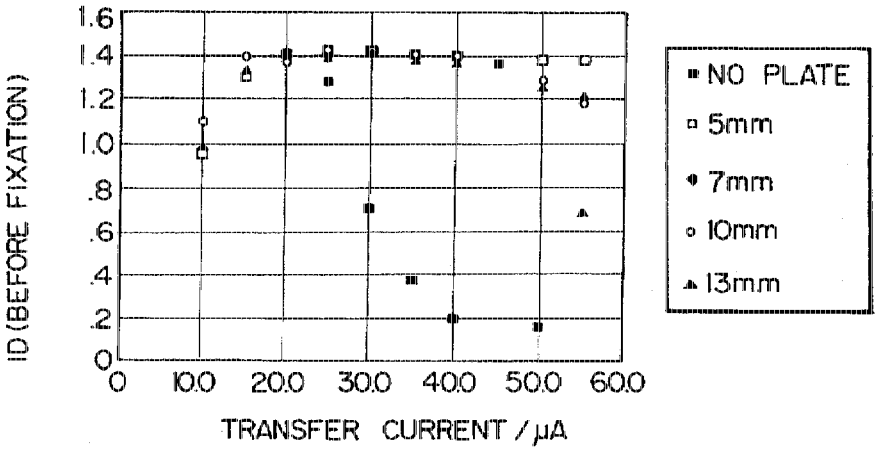

FIGS. 27A–27C and 28A–28C show the results of the above evaluation. FIG. 27A shows how the faithfulness changes with a change in pressure. FIG. 27B shows how the glance picture quality changes with a change in pressure. FIG. 27C shows how the ID of a solid portion changes with a change in pressure. FIG. 28A shows a relation between the faithfulness and the pressing position. FIG. 28B shows a relation between the glance image quality and the pressing position. Further, FIG. 28C shows a relation between the ID of a solid portion and the pressing position.

The evaluation showed that the support member 125 successfully prevents defective images including blurred images. Specifically, as FIGS. 27A–27C indicate, when the pressure is 510 gf or 770 gf, and when the transfer current is 20 μA to 35 μA, an attractive image even superior to the best image achieved with the copier in the past is attainable. As FIGS. 28A–28C indicate, the end position of the presser plate should preferably be 5 mm, 7 mm or 10 mm at the upstream side; an attractive image even superior to the best image achieved with the copier in the past is attainable when the transfer current is 20 μA to 35 μA.

Figure 29:
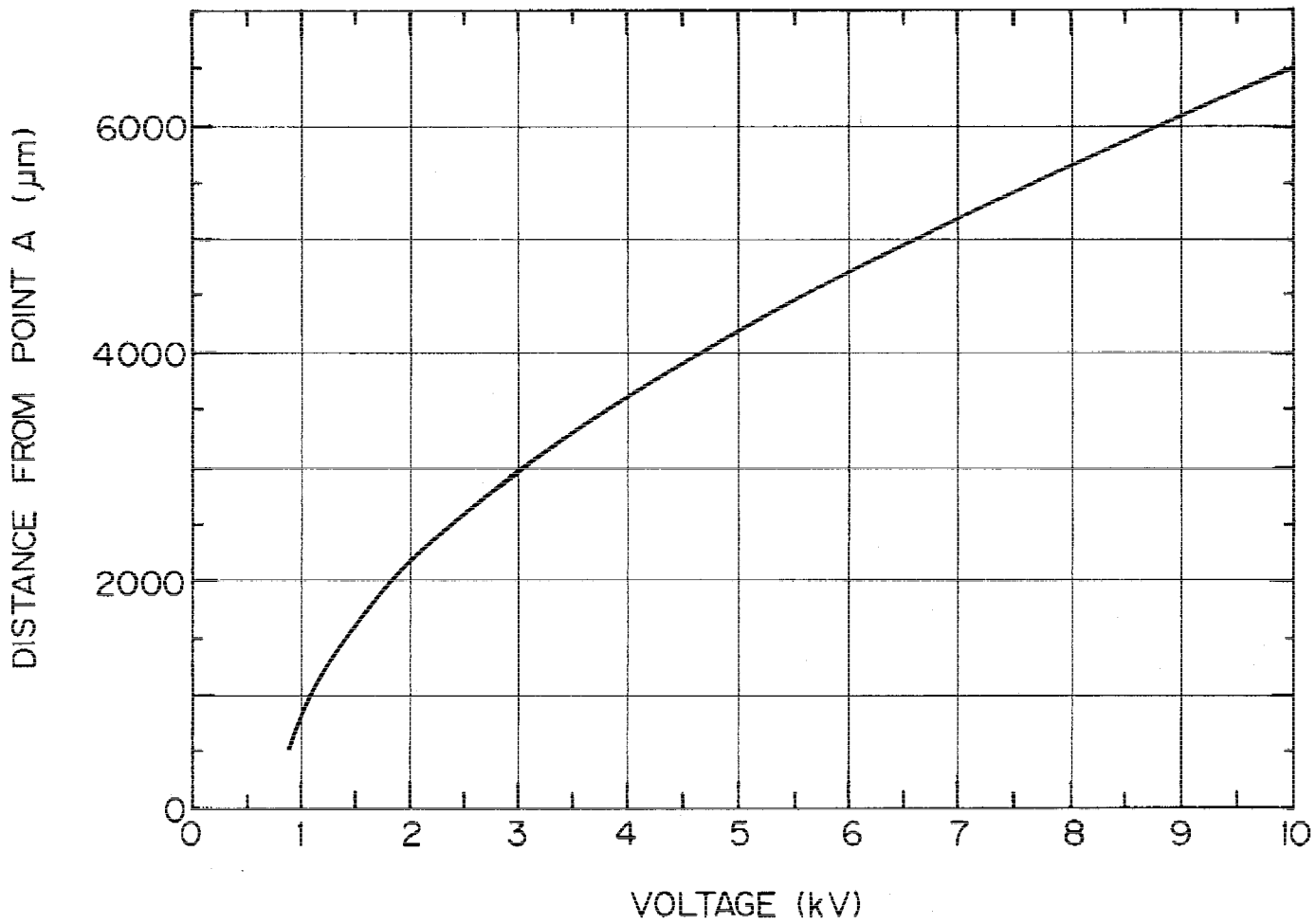
FIG. 29 is a graph representative of a relation between a voltage for image transfer and a distance between a belt and a charge roller.

It is to be noted that light ascribable to discharge is observed in the vicinity of the point A of the charge roller 124 at the upstream side. FIG. 29 shows a relation between the transfer voltage and the position where the discharge begins (distance from the point A of the charge roller). This relation was derived from the Paschen's curve and the geometric calculation as to the structure of the image transfer section. As the voltage increases, the discharge start position, i.e., transfer start position is shifted away from the point A of charge roller. In the graph shown in FIG. 29, the discharge start position is 2 mm to 5 mm for the voltage of 2 kV to 8 kV. Assuming that the belt 14 and paper S are free from slackening, the distance between the drum 10 and the paper S is about 100 μm to 500 μm. When the support member 125 was absent, the deterioration of the image occurred when the voltage was higher than 4.5 kV (25 μA in terms of current). In this case, the discharge start position is about 3.5 mm, and the distance between the drum 10 and the paper S is about 250 μm.

Figure 30A:
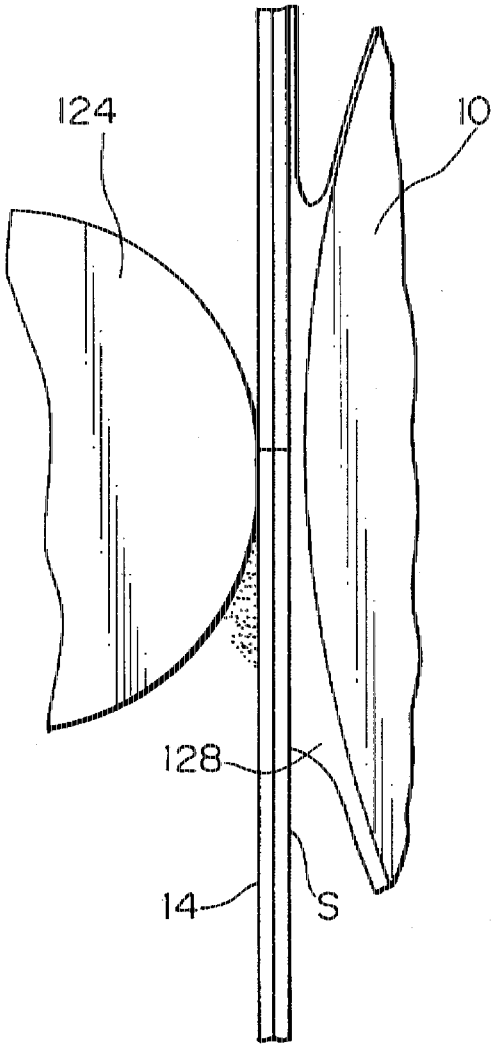
FIGS. 30A and 30B respectively show an image transfer position where a support member is absent, and an image transfer position where it is present.
Figure 30B:
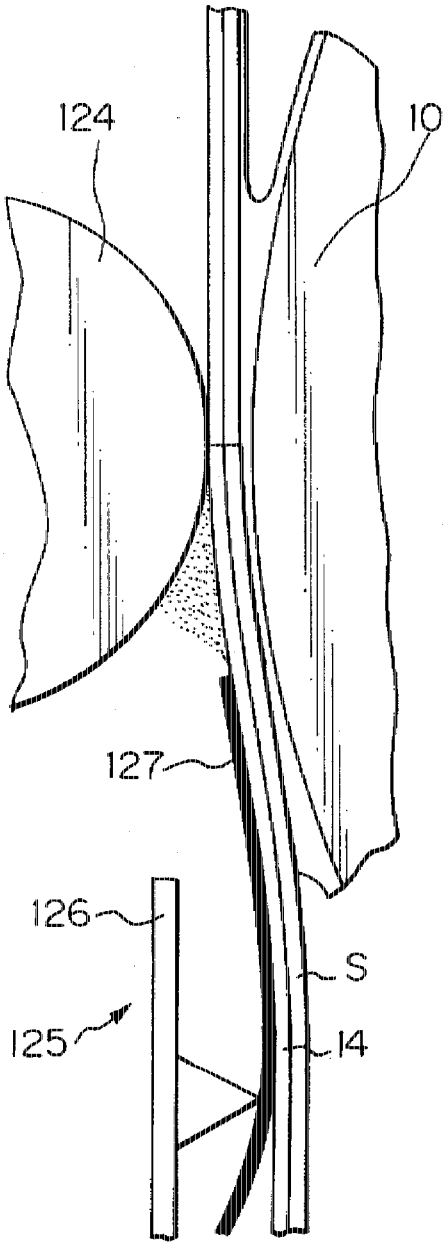

FIGS. 30A and 30B are sketches respectively showing a condition wherein the support member 125 is absent, and a condition wherein it is present. The carder layer and toner layer formed on the drum 10 are about 1 μm thick and about 10 μm thick, respectively. When an area whose major part is occupied by a toner image is transferred, it is likely that the liquid carrier stands around the inlet of the nip between the drum 10 and the charge roller 124, forming a mass 128. The mass 128 may even swirl, depending on its size.

Figure 31A:
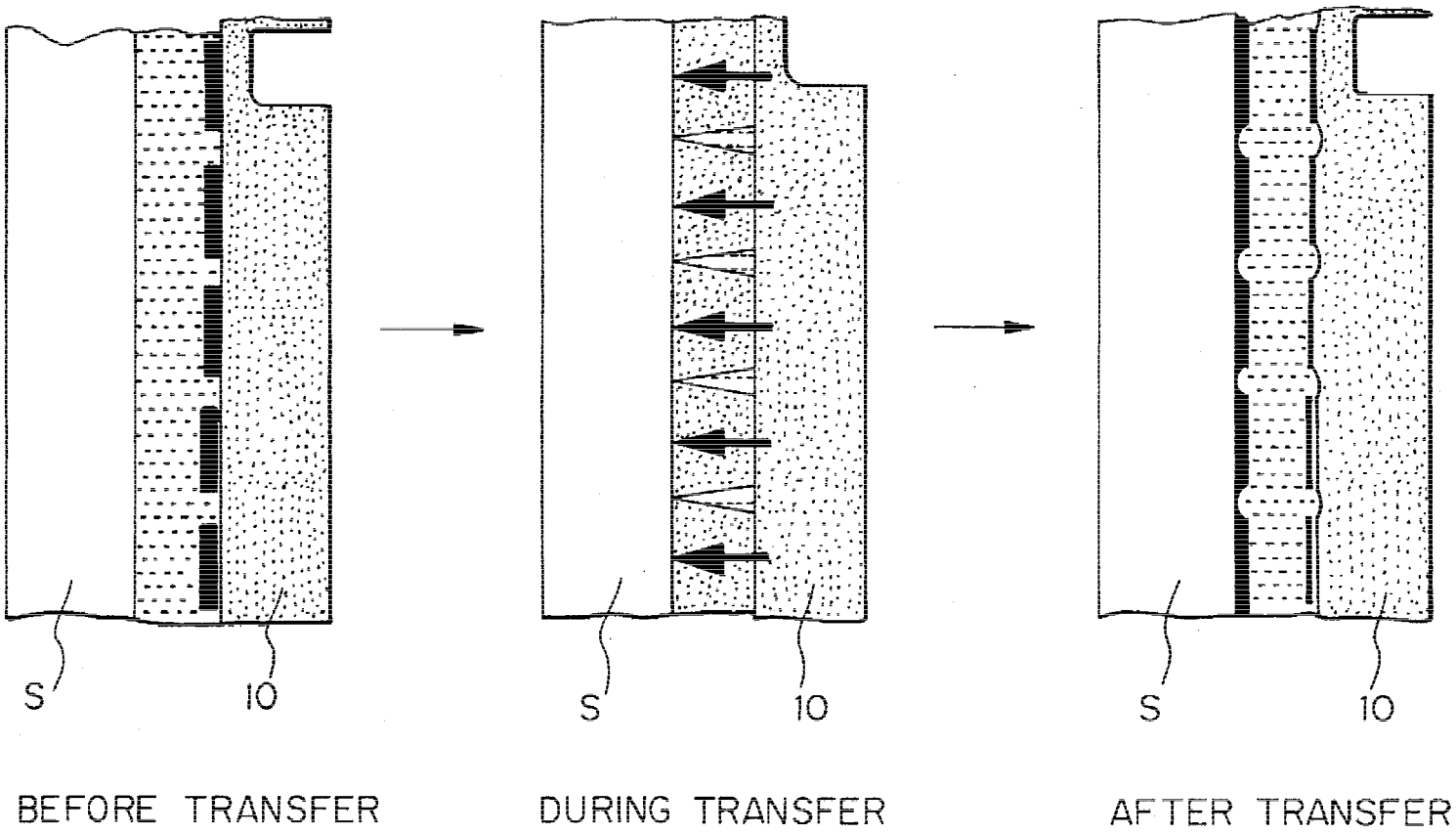
FIG. 31A shows a condition wherein image transfer is effected at a position where a liquid carrier forms a mass.

FIG. 31A demonstrates a condition wherein image transfer is effected at the mass 128 of the liquid carrier. Presumably, this easily disturbs the toner in the direction of the paper surface and thereby blurs the edges of the image. As far as the previously stated samples are concerned, images with blurred edges are observed when the support member 125 is absent. Conversely, when an area which is slightly occupied by the toner image is transferred, it is likely that the liquid carrier is short even at the point A of the charge roller, resulting in bores between the paper S and the drum 10.

Figure 31B:
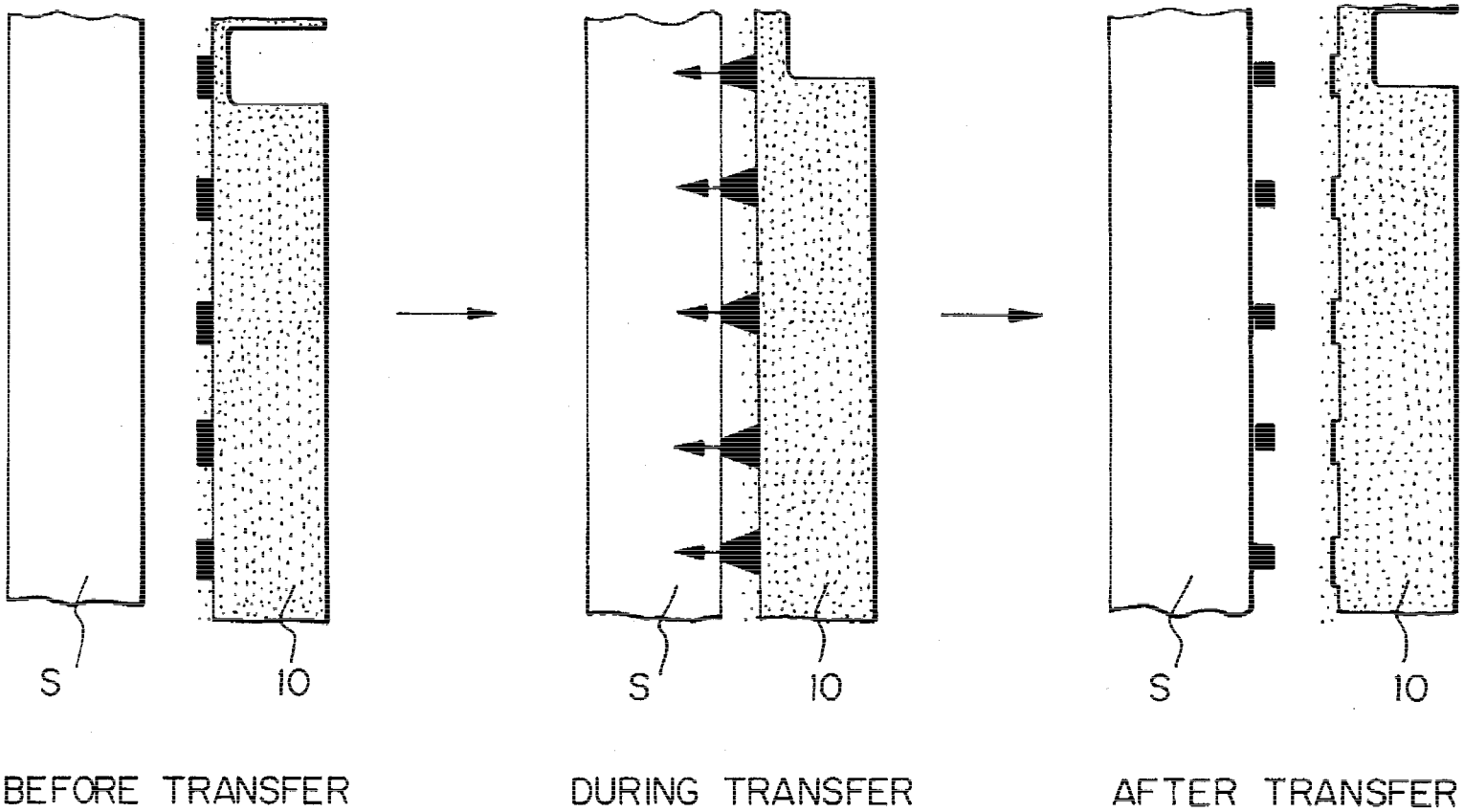
FIG. 31B shows a condition wherein bores exist between a paper and a drum.

FIG. 31B shows a condition where bores are produced between the paper S and the drum 10. Presumably, the bores prevent the toner and paper from closely contacting each other and thereby reduce the size of the image, or intensify the contact excessively and thereby defaces the image. As far as the samples are concerned, the image is reduced in size when the support member 125 is absent.

In order to achieve an attractive image, the contact should presumably be effected up to the thickness (about 10 μm) of the toner layer before the deposition of the charge. However, the prerequisite is that the gap between the paper S and the drum 10 be filled with the carrier liquid. It is regarded that the improvement in image quality derived from the rearrangement of the support member 125 and charge roller 124 stems from the close contact of the paper S and the drum 10 achieved before the deposition of the charge which is ascribable to the discharge.

Various modifications will become possible for those skilled in the art after receiving the teachings of the present disclosure without departing from the scope thereof.

What is claimed is:

1. A wet process image forming apparatus comprising:

a developing device storing a developing liquid comprising a carrier liquid and a a carrier vapor collecting device, said carrier vapor collecting device comprising:

(a) liquefying means for liquefying carrier vapor collected, wherein air from which the carrier vapor is removed by said liquefying means is returned into a body of the image forming apparatus;

(b) separating means for separating a liquid produced by said liquefying means into the carrier liquid and water; and (c) a chamber formed by a cover member substantially hermetically enclosing a fixing section of said apparatus where the carrier vapor is easily produced, wherein said chamber is formed with an outlet through which an air stream flows out toward said liquefying means, and an inlet through which the air from which the carrier vapor is removed enters said chamber, wherein said inlet and said outlet communicate with each other, and wherein said outlet and said inlet face each other at opposite sides of said fixing section.

2. An apparatus as claimed in claim 1, wherein staid outlet, the fixing section and said inlet are sequentially arranged in a direction in which a recording medium is conveyed through said fixing section, and wherein said said inlet is located at a most downstream side with respect to said direction.

3. A wet process image forming apparatus comprising:

a developing device storing a developing liquid comprising a carrier liquid and a toner; and a carrier vapor collecting device, said carrier vapor collecting device comprising:

(a) liquefying means for liquefying carrier vapor collected, wherein air from which the carrier vapor is removed by said liquefying means is returned into a body of the image forming apparatus, wherein said liquefying means liquefies the carrier vapor by cooling, and wherein a heater using waste heat provided by said liquefying means heats an air stream flowing from said liquefying means toward the inside of said body of said apparatus; and (b) separating means for separating a liquid produced by said liquefying means into the carrier liquid and water.

4. A wet process image forming apparatus comprising:

a developing device storing a developing liquid comprising a carrier liquid and a toner;

a carrier vapor collecting device, said carrier vapor collecting device comprising:

(a) liquefying means for liquefying carrier vapor collected wherein air from which the carrier is removed by said liquefying means is returned into a body of the image forming apparatus; and (b) separating means for separating means for separating a liquid produced by said liquefying means into the carrier liquid and water; and temperature adjusting means for adjusting a temperature of an air stream flowing from said liquefying means toward the inside of said body of said apparatus.

5. A wet process image forming apparatus comprising:

a developing device storing a developing liquid comprising a carrier liquid and a toner, said developing device comprising:

(a) a tank storing the developing liquid;

(b) a container storing a carrier liquid to be replenished into said tank;

(c) sensing means for sensing an amount of the carrier liquid stored in said container; and (d) control means for controlling a supply of the carrier liquid to said developing device in response to an output of said sensing means such that said supply is increased when said amount of the carrier liquid is decreased; and a carrier vapor collecting device, said carrier vapor collecting device comprising:

(a) liquefying means for liquefying carrier vapor collected;

(b) separating means for separating a liquid produced by said liquefying means into the carrier liquid and water;

(c) a conduit member for feeding the carrier liquid separated by said separating means to said developing device, wherein said control means controls said supply of the carrier liquid to said developing device via said conduit member; and (d) pressure generating means for generating a pressure for forcing the carrier liquid into said conduit member.

6. A wet process image forming apparatus comprising:

a developing device storing a developing liquid comprising a carrier liquid and a toner; and a carrier vapor collecting device, said carrier vapor collecting device comprising:

(a) liquefying means for liquefying carrier vapor collected;

(b) separating means for separating a liquid produced by said liquefying means into the carrier liquid and water;

(c) a conduit member for feeding the carrier liquid separated by said separating means to said developing device; and (d) pressure generating means for generating a pressure for forcing the carrier liquid into said conduit member, wherein the supply of the carrier liquid via said conduit member is performed for one of a plurality of developing devices, wherein said one of said plurality of developing devices consumes the carrier liquid more quickly than the other developing devices, and wherein said one of said plurality of developing devices comprises:

(i) a developing liquid tank storing the developing liquid;

(ii) a carrier liquid container storing a carrier liquid to be replenished into said developing liquid tank;

(iii) sensing means for sensing an amount of the developing liquid remaining in said developing liquid tank; and (iv) control means for controlling a supply of the carrier liquid to the developing device via said conduit member in response to an output of said sensing means, such that said supply is increased when said amount of the developing liquid is decreased.

* * * * *